US006925277B2

(12) United States Patent
Sugihara

(10) Patent No.: US 6,925,277 B2
(45) Date of Patent: Aug. 2, 2005

(54) DEVELOPING DEVICE USING A DEVELOPER CARRIER FORMED WITH GROOVES AND IMAGE FORMING APPARATUS INCLUDING THE SAME

(75) Inventor: Kazuyuki Sugihara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/459,623

(22) Filed: Jun. 12, 2003

(65) Prior Publication Data

US 2004/0028428 A1 Feb. 12, 2004

(30) Foreign Application Priority Data

Jun. 12, 2002 (JP) ..... 2002-171161
Jun. 19, 2002 (JP) ..... 2002-179070

(51) Int. Cl.[7] ..... G03G 15/09
(52) U.S. Cl. ..... 399/276; 399/267
(58) Field of Search ..... 399/265, 267, 399/270, 274, 275, 276, 277

(56) References Cited

U.S. PATENT DOCUMENTS

| | | | | |
|---|---|---|---|---|
| 4,389,113 A | | 6/1983 | Matsumoto et al. | |
| 4,597,661 A | | 7/1986 | Yamashita | |
| 4,637,706 A | * | 1/1987 | Hosoi et al. | 399/275 |
| 4,721,982 A | * | 1/1988 | Ueda | 399/276 X |
| 5,153,376 A | * | 10/1992 | Tomita | 399/276 |
| 5,202,729 A | | 4/1993 | Miyamoto et al. | |
| 5,552,877 A | | 9/1996 | Ishikawa et al. | |
| 5,646,721 A | | 7/1997 | Sugihara et al. | |
| 5,657,115 A | | 8/1997 | Sugihara | |
| 5,671,470 A | | 9/1997 | Maruta et al. | |
| 5,758,235 A | | 5/1998 | Kosuge et al. | |
| 5,761,576 A | | 6/1998 | Sugihara et al. | |
| 5,768,664 A | | 6/1998 | Kosuge et al. | |
| 5,787,328 A | | 7/1998 | Sugihara et al. | |
| 5,826,146 A | | 10/1998 | Maruta et al. | |
| 5,850,586 A | | 12/1998 | Sugihara et al. | |
| 5,940,664 A | | 8/1999 | Sugihara et al. | |
| 5,956,549 A | | 9/1999 | Sugihara et al. | |
| 5,991,569 A | | 11/1999 | Sugihara et al. | |
| 6,070,037 A | | 5/2000 | Sugihara et al. | |
| 6,072,967 A | | 6/2000 | Sugihara et al. | |
| 6,104,900 A | | 8/2000 | Ishikawa et al. | |
| 6,122,469 A | | 9/2000 | Miura et al. | |
| 6,141,520 A | | 10/2000 | Kosuge | |
| 6,226,481 B1 | | 5/2001 | Yoneda et al. | |
| 6,336,020 B1 | | 1/2002 | Ishikawa et al. | |
| 6,500,595 B1 | | 12/2002 | Mochizuki et al. | |
| 6,522,854 B2 | * | 2/2003 | Nishiuwatoko | 399/267 |
| 6,546,222 B2 | * | 4/2003 | Sakemi et al. | 399/276 |
| 6,615,014 B2 | | 9/2003 | Sugihara | |

FOREIGN PATENT DOCUMENTS

| | | |
|---|---|---|
| EP | 0 913 741 | 5/1999 |
| JP | 2001-134069 | 5/2001 |
| JP | 2001-330997 | 11/2001 |

OTHER PUBLICATIONS

Patent Abstracts of Japan, JP 2000–321864, Nov. 24, 2000.

* cited by examiner

*Primary Examiner*—Sandra L. Brase
(74) *Attorney, Agent, or Firm*—Oblon, Spivak, McClelland, Maier & Neustadt, P.C.

(57) ABSTRACT

A developing device of the present invention includes a developing roller including a sleeve and a magnet roller accommodated in the sleeve. The surface of the sleeve s configured such that the center portion, including an image forming range corresponding to the image forming range of an image carrier, in the direction of width perpendicular to the direction of movement of the above has a higher developer conveying ability than opposite end portions outward of the center portion. Opposite ends of the magnetic pole of the magnet roller in the direction of width face the opposite end portions of the sleeve.

65 Claims, 30 Drawing Sheets

FIG. 31

| | 4TH EXAMPLE | PRIOR ART SLEEVE WITH V GROOVES | SLEEVE WITH PLAIN GROOVES | SANDBLASTED SLEEVE |
|---|---|---|---|---|
| CONVEYING ABILITY | O | O | O | × |
| BANDING | O | × | × | O |
| CARRIER DEPOSITION | O | × | × | O |

DEVELOPING DEVICE USING A DEVELOPER CARRIER FORMED WITH GROOVES AND IMAGE FORMING APPARATUS INCLUDING THE SAME

BACKGROUND OF THE INVENTION

The present invention relates to a copier, printer, facsimile apparatus or similar image forming apparatus and a developing device and a process cartridge for the same and more particularly to a developing device of the type using a developer carrier formed with a number of grooves.

DESCRIPTION OF THE PRIOR ART

It is a common practice with an image forming apparatus to use a developing device configured to develop a latent image formed on an image carrier with a developer, which is deposited on a developer carrier, in a developing region where the developer carrier and image carrier face each other. A problem with this type of developing device is that when the amount of the developer deposited on the developer carrier decreases, the resulting image appears non-smooth. Therefore, the prerequisite with this type of developing device is that the developer be scooped up to the developer carrier in an amount stable enough to insure high image quality.

It has been reported that the amount of the developer to deposit on the developer carrier is susceptible to the frictional resistance of the surface of the developer carrier, i.e., the former decreases with a decrease In the latter. In this sense, increasing the frictional resistance of the developer carrier is effective to stabilize the amount of the developer to deposit on the developer carrier. For this purpose, the surface of the developer carrier may be roughened by sandblasting, as taught in, e.g., Japanese Patent Publication No. 1-5711. However, the frictional resistance of a rough surface formed by sandblasting is apt to decrease due to wear ascribable to the developer as development is repeated. It is therefore difficult with the sandblasted surface to maintain the amount of the developer to deposit on the developer carrier stable over a long time.

In light of the above, Japanese Patent Laid-Open Publication No. 2000-321864, for example, discloses a developing roller whose surface is formed with a plurality of axially extending grooves. The grooves are configured to increase the frictional resistance of the surface of the developing roller for thereby stabilizing the amount of the developer to deposit on the surface. The grooves do not easily disappear despite aging, so that the frictional resistance of the above surface decreases little. The developing roller can therefore allow the developer to deposit thereon in a stable amount over a long time.

Japanese Patent Laid-Open Publication No. 2001-134069 also teaches a developing device using a developing sleeve or developer carrier formed with a plurality of axially extending grooves or recesses.

However, the conventional developing devices using a developer carrier provided with a rough surface, as stated above, have some problems left unsolved, as will be described hereinafter. First, stripe-like pitch irregularity or so-called banding, corresponding to the pitch of the grooves, appears in a toner image. The pitch irregularity is ascribable to the fact that an electric field or a magnetic field in the developing zone varies from a portion where the surface of the developer carrier faces the surface of the image carrier to a portion where the grooves of the former face the latter.

Therefore, how the degradation of image quality ascribable to the pitch irregularity should be reduced is a problem awaiting solution. Particularly, in a color image forming apparatus capable of forming a color image, the pitch irregularity appears in each of toner images of different colors to be superposed, critically degrading image quality.

Second, it is likely that the developer adheres to the surface of the developer carrier due to an increase in developer pressure at opposite end portions of the developer carrier in the developing zone or that the developer come off from the opposite end portions of the developer carrier. Particularly, the developer adhered to the opposite end portions of the developer carrier brings about various serial problems including the peeling of the surface layer of the image carrier, an image smeared at opposite edge portions, a banding image ascribable to the increase or the variation of drive load, and defective cleaning.

Further, I experimentally found that the adhesion of the developer and other problems stated above are apt to occur when use is made of a developer having a small grain size for enhancing image quality or when a gap for development is narrowed.

SUMMARY OF THE INVENTION

It is a first object of the present invention to provide a developing device and a process cartridge capable of reducing, while insuring stable conveyance of a developer in an image forming range, the adhesion of the developer to the surface of a developer carrier ascribable to the above-described occurrence, and an image forming apparatus including the same.

It is a second object of the present invention to provide a developing device capable of insuring a high-quality image free from conspicuous pitch irregularity ascribable to the grooves.

A developing device of the present invention includes a developer carrier whose surface is movable to convey a developer deposited thereon to a developing zone where the developer carrier faces an image carrier. A magnetic field generating member is accommodated in the developer carrier for forming a magnetic field that retains the developer on the surface of the developer carrier. A metering member faces the surface or the developer carrier for regulating the amount of the developer being conveyed by the surface toward the developing zone. The surface of the developer carrier is configured such that the center portion, including an image forming range corresponding to the image forming range of the image carrier, in the direction of width perpendicular to the direction of movement of the surface has a higher developer conveying ability than opposite end portions outward of the center portion. Opposite ends of a magnetic pole provided on the magnetic field generating member in the direction of width face the opposite end portions of the developer carrier.

An image forming apparatus including the above developing device is also disclosed.

BRIEF DESCRIPTION OF THE DRAWINGS

The above and other objects, features and advantages of the present invention will become more apparent from the following detailed description taken with the accompanying drawings in which:

FIG. 31 is a table comparing the second embodiment and conventional sleeves as to developer conveying ability, banding and carrier deposition;

DESCRIPTION OF THE PREFERRED EMBODIMENTS

Figure 1:
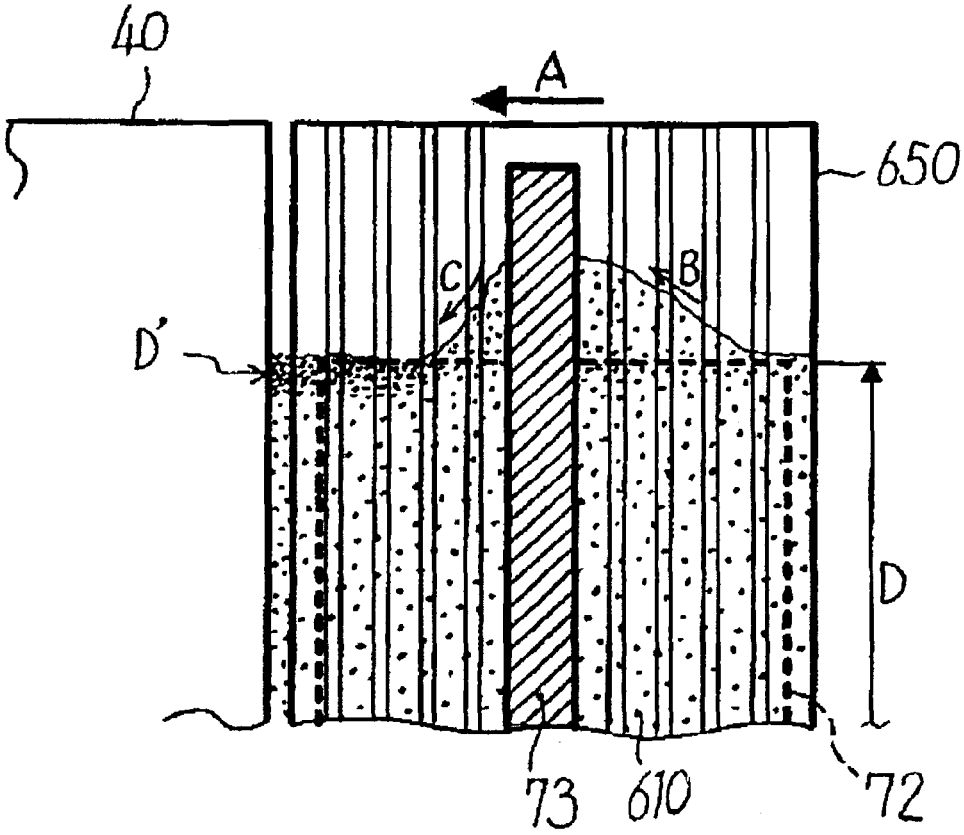
FIG. 1 PRIOR ART
FIG. 1 demonstrates the movement of a developer around the end portion of a sleeve included in a conventional developing device.

Preferred embodiments of the present invention will be described hereinafter.

First Embodiment

A first embodiment of the present invention is mainly directed toward the first object stated earlier. First, to better understand the present invention, reference will be made to FIG. 1 for describing the problem of the conventional developing device of the type using a developer carrier formed with a plurality of grooves. As shown, the developer carrier includes a sleeve 650 accommodating a stationary magnet member or magnetic field forming means 72. The axial length of the magnet member 72 is matched to the length of an image forming range D of the sleeve 650. When the surface of the sleeve 650 moves in a direction indicated by an arrow A in FIG. 1, a developer 610 deposited on the sleeve 650 spreads from the end of the image forming range D axially outward, as indicated by an arrow B, when passing a position where a doctor or metering member 73 is located.

Subsequently, the developer 610 moved away from the doctor 73 again gathers toward the image forming range D, as indicated by an arrow C in FIG. 1, due to the concentrated magnetic force at the end of the magnet member 72. As a result, the developer on the sleeve 650 reaches a developing zone or nip between the sleeve 650 and a photoconductive drum or image carrier 40 in a larger amount at opposite end portions D' (only one is shown) in the direction of width than at the other portion. It follows that the developer density increases at each end portion D' of the image forming range D, so that the developer is apt to adhere to the sleeve 650 or drop from the opposite end portions of the sleeve 650.

The first embodiment of the present invention will be described hereinafter and is applied to a tandem, electrophotographic color copier by way of example. Generally, a tandem, image forming apparatus includes a plurality of photoconductive drums or image carriers arranged side by side and a plurality of developing units each being assigned to a particular drum. Toner images of different colors each being formed on one of the drums are sequentially transferred to a sheet or recording medium one above the other, completing a composite color image. The tandem, image forming apparatus implements a far higher printing speed than an image forming apparatus of the type repeating image formation with a single photoconductive drum. However, the problem with the tandem image forming apparatus is bulky due to a plurality of image forming sections.

Figure 2:
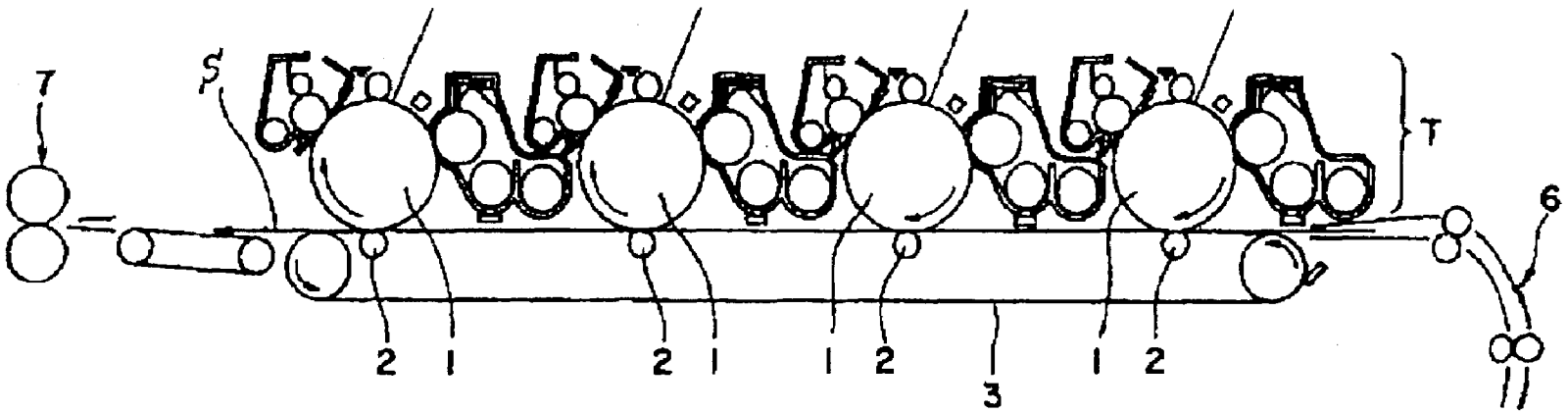
FIG. 2 is a view showing a direct image transfer type of tandem, image forming apparatus.
Figure 3:
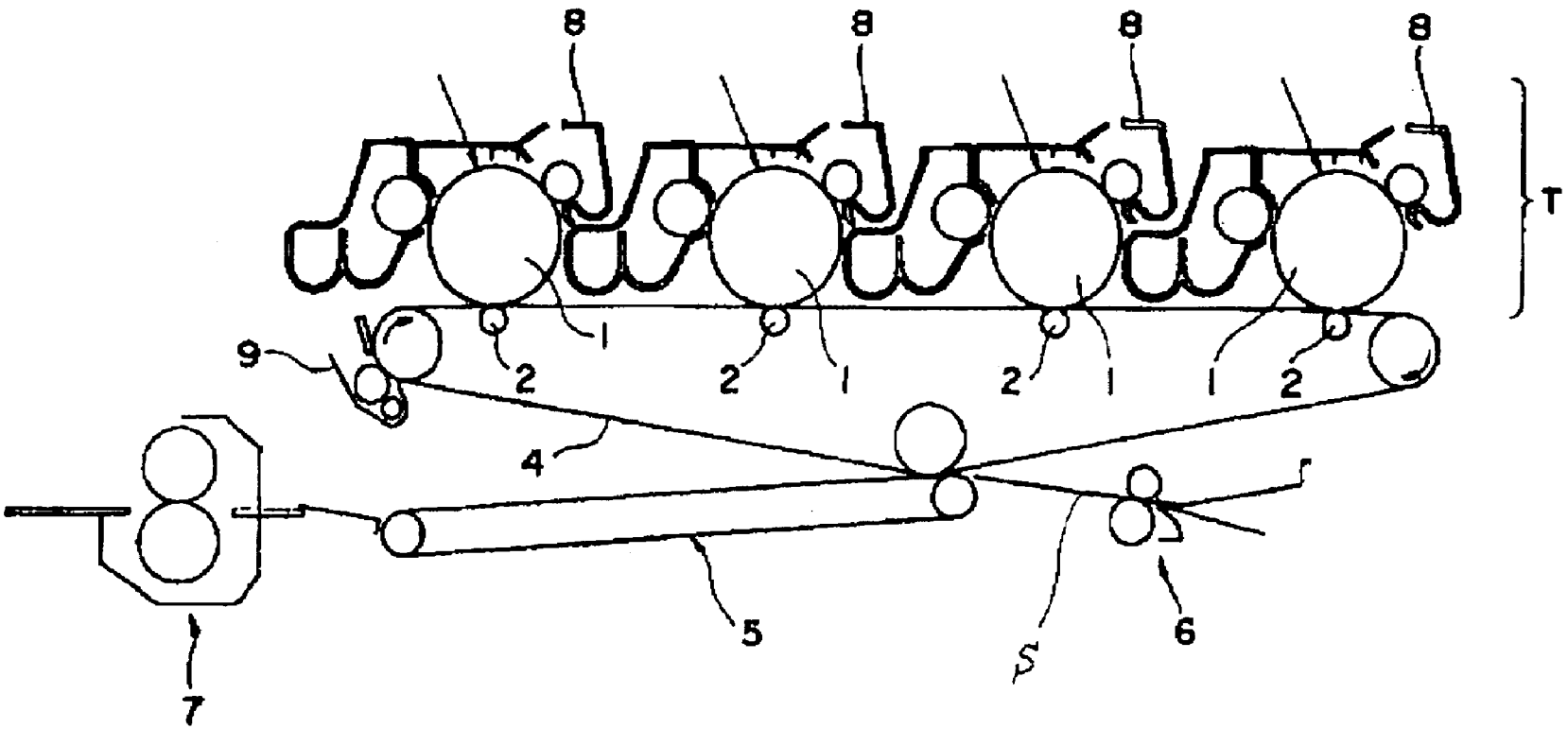
FIG. 3 is a view showing an indirect image transfer type of tandem, image forming apparatus.

The tandem, image forming apparatus uses either one of a direct and an indirect image transfer system, as will be described hereinafter. As shown in FIG. 2, in the direct image transfer system, image transferring devices 2 sequentially transfer toner images from photoconductive drums 1 to a sheet S being conveyed by a belt 3 one above the other. As shown in FIG. 3, in the indirect image transfer system, the toner images formed on the drums 1 are sequentially transferred to an intermediate image transfer belt 4 by primary image transferring devices 2, and then the resulting composite color image is transferred from the belt 4 to the sheet S by a secondary image transferring device 5.

In the direct image transfer system, a sheet feeding device 6 and a fixing device 7 must be respectively located upstream of the image forming section, labeled T, and downstream of the same, further increasing the overall size of the apparatus in the direction of sheet conveyance. If the fixing device 7 is positioned closer to the image forming section T in order to reduce the overall size as far as possible, then a margin for the sheet S to form a loop is not available. As a result, the trailing edge of an image is apt to be defective due to, e.g., an impact to occur when the leading edge of the sheet S enters the fixing device or a difference in sheet conveying speed to occur when the leading edge of the sheet S leaves the fixing device 7.

On the other hand, in the indirect image transfer system, the secondary image transfer position can be relatively freely located. Therefore, as shown in FIG. 3, it is possible to locate the secondary image transfer position remote from the primary image transfer positions facing the drums 1 and to position the sheet feeding device 6 and fixing device 7 below the image forming section T. This successfully reduces the overall size of the apparatus at the sides upstream and downstream of the image forming section T, i.e., in the horizontal direction in FIG. 3. In addition, the fixing device 7 can be located with a margin sufficient for the sheet S to form a loop, it does not effect an image when the sheet S is conveyed. For the reasons described above, the tandem, image forming apparatus using the indirect image transfer system is attracting attention.

Figure 4:
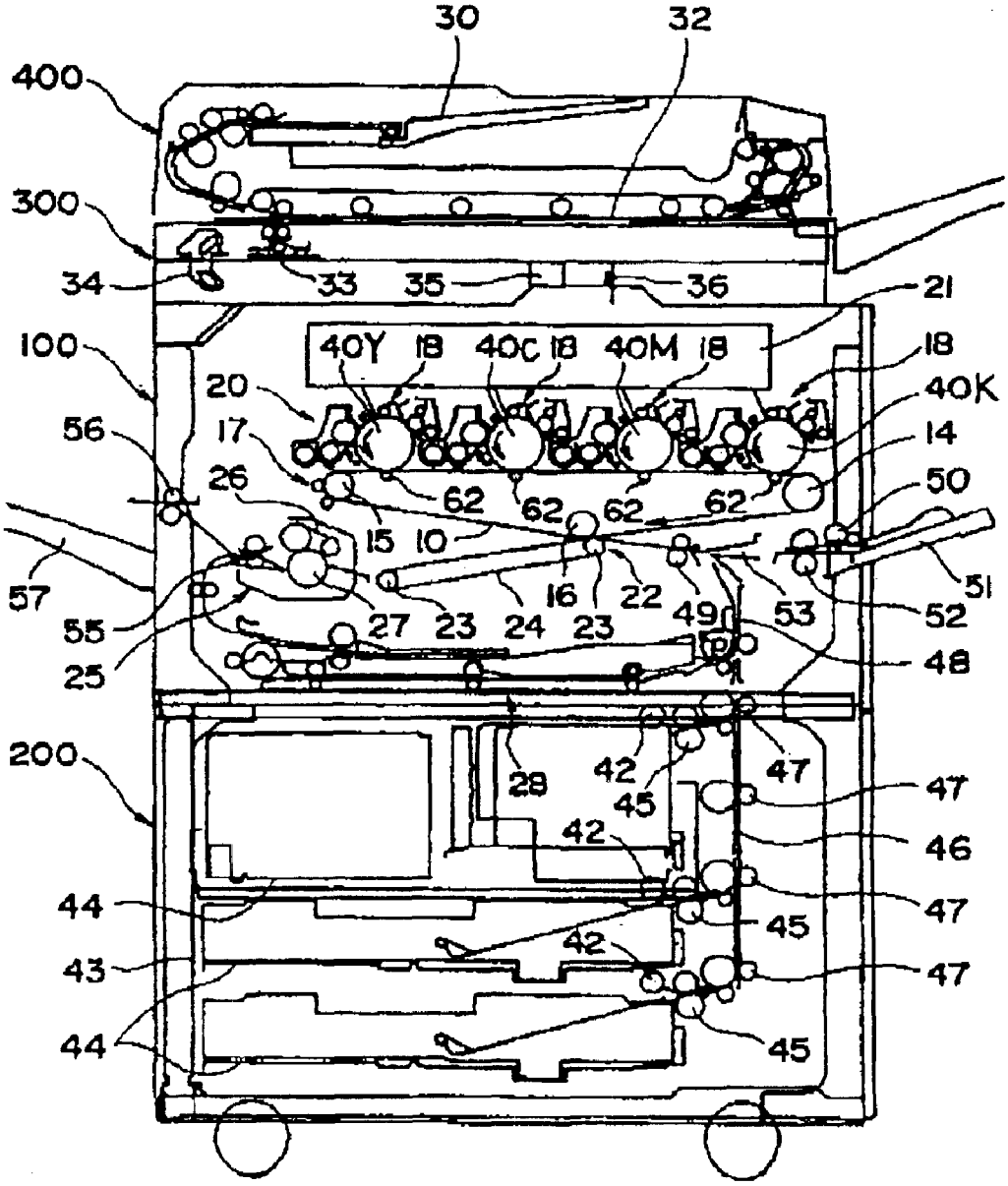
FIG. 4 is a view showing an image forming apparatus to which preferred embodiments of the present invention are applied.

Referring to FIG. 4, a tandem, image forming apparatus using the indirect image transfer system embodying the present invention is shown and implemented as a copier by way of example. As shown, the copier includes a copier body 100, a sheet feed table 200 on which the copier body 100 is mounted, a scanner 300 mounted on the top of the copier body 100, and an ADF (Automatic Document Feeder) 400 mounted on the top of the scanner 300.

Figure 5:
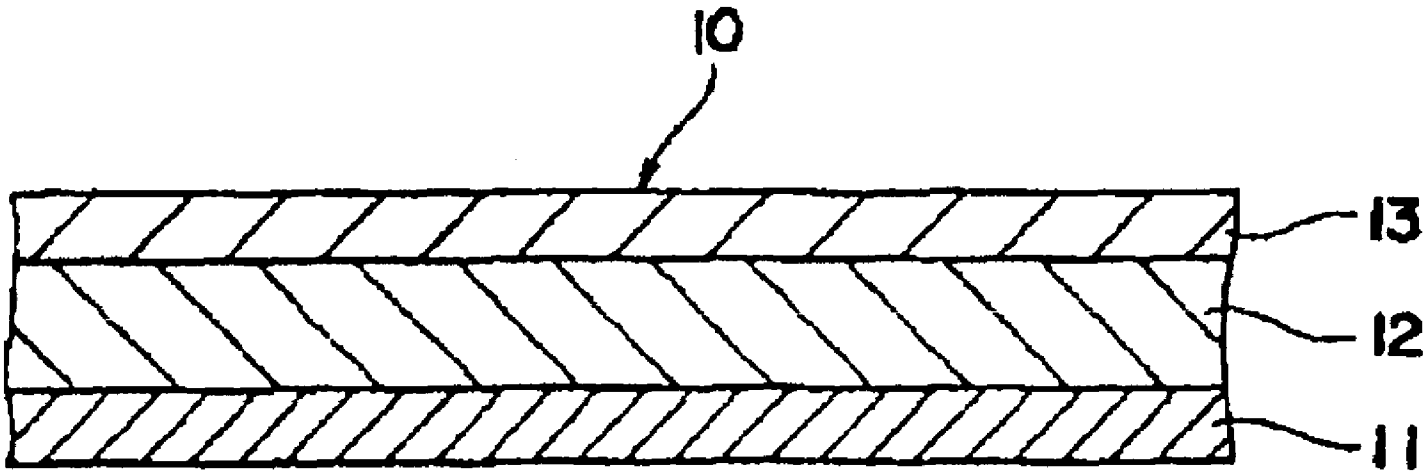
FIG. 5 is a fragmentary section showing an intermediate image transfer belt included a first embodiment of the present invention.

An endless, intermediate image transfer belt 10 is positioned at the center of the copier body 100 and serves as an intermediate image transfer body. FIG. 5 shows a specific structure of the intermediate image transfer belt (simply belt hereinafter) 10. As shown, the belt 10 is made up of a base layer 11, an elastic layer 12 and a coating layer 13, as named from the inside toward the outside. The base layer 11 is formed of, e.g., fluorocarbon resin or sailcloth that stretches little. The elastic layer 12 is formed of, e.g., fluorine-containing rubber or acrylonitrile-butadien copolymer rubber. The coating layer 13, covering the elastic layer 12, is formed of, e.g., fluorine-containing resin for forming a smooth surface.

Referring again to FIG. 4, the belt 10 is passed over a first, a second and a third roller 14, 15 and 16 serving as support members and is movable clockwise, as viewed in FIG. 4. A belt cleaner 17 adjoins the second roller 15 for removing residual toner left on the belt 10 after image transfer. Black, yellow, magenta and cyan image forming means 18 are sequentially arranged side by side on the upper run of the belt 10 between the first and second rollers 14 and 15, constituting a tandem, image forming section 20 in combination. An optical writing unit 21 is positioned above the tandem, image forming section 20.

A secondary image transferring device 22 is positioned at the opposite side to the image forming section 20 with respect to the belt 10. The secondary image transferring device 22 includes an endless, secondary image transfer belt 24 passed over two rollers 23 and pressed against a third roller 16 via the belt 10, so that a toner image can be transferred from the belt 10 to a sheet.

A fixing unit 25 is positioned at one side of the secondary image transferring device 22 for fixing the toner image carried on the sheet. The fixing unit 25 includes an endless, fixing belt 26 and a roller 27 pressed against the belt 26.

The secondary image transferring device 22 bifunctions to convey the sheet, carrying the toner image thereon, to the fixing unit 25. Although the secondary image transferring device 22 may, of course, be implemented by a transfer roller or a non-contact type charger, it is difficult to provide the transfer roller or the charger with the sheet conveying function.

A sheet turning device 28 is arranged below the secondary image transferring device 22 and fixing unit 25 in parallel to the image forming section 20. The sheet turning device 28 turns back a sheet in a duplex copy mode.

In operation, the operator of the copier stacks desired documents on a document tray 30 included in the ADF 400 or opens the ADF 400, lays a single document on a glass platen 32 included in the scanner 300, and then closes the ADF 400. Subsequently, the operator presses a start switch not shown. In response, the ADF 400 conveys one document from the document tray 30 to the glass platen 32, When a single document is laid on the glass platen 32 by hand, the scanner 300 is immediately driven to cause its first and second carriages 33 and 34 to move. While a light source mounted on the first carriage 33 illuminates the document, the resulting reflection from the document is reflected toward the second carriage 34, reflected by a mirror mounted on the second carriage 34 to an image sensor 36 via a lens 35.

When the start switch is pressed, a drive motor, not shown, causes one of the rollers 14 through 16 to rotate for thereby moving the belt 10; the other two rollers are driven by the belt 10. At the same time, photoconductive drums 40B (K), 40M (magenta), 40C (cyan) and 40Y (yellow) included in the four image forming means 18 each are rotated to form one of a black, a magenta, a cyan and a yellow toner image thereon. The black to yellow toner images are sequentially transferred from the drums 40B through 40Y to the belt 10 being moved one above the other, completing a composite color image on the belt 10.

Further, when the start switch is pressed, one of pickup rollers 200 arranged in the sheet feed table 200 is caused to rotate and pay out a sheet from associated one of sheet cassettes 44, which are stacked one upon the other in a paper bank 43. At this instant, a reverse roller 45 separates the above sheet being paid out from the underlying sheets. The sheet thus paid out is conveyed by a roller pair 47 to a path 46 and then introduced into a path 48, which is formed in the copier body 100. The sheet is then stopped by a registration roller pair 49. On the other hand, a sheet, paid out from a manual feed tray by a pickup roller 50, is conveyed via a path 53 to the registration roller pair 49 and then stopped by the roller pair 49.

Subsequently, the registration roller pair 49 conveys the sheet in synchronism with the movement of the belt 10 to thereby deliver the sheet to the nip between the belt 10 and the secondary image transferring device 22. As a result, the composite color image is transferred from the belt 10 to the sheet.

The sheet with the color image is conveyed to the fixing unit 25 by the secondary image transferring device 22, so that the color image is fixed on the sheet by heat and pressure. A path selector 55 steers the sheet, coming out of the fixing unit 25, toward an outlet roller pair 56 The outlet roller pair 56 drives the sheet out of the apparatus body 100 to a tray 57.

After the image transfer, the belt cleaner 17 removes toner left on the belt 10 to thereby prepare the belt 10 for the next image formation.

While the registration roller pair 49 is generally grounded, a bias may be applied thereto for removing paper dust.

Figure 6:
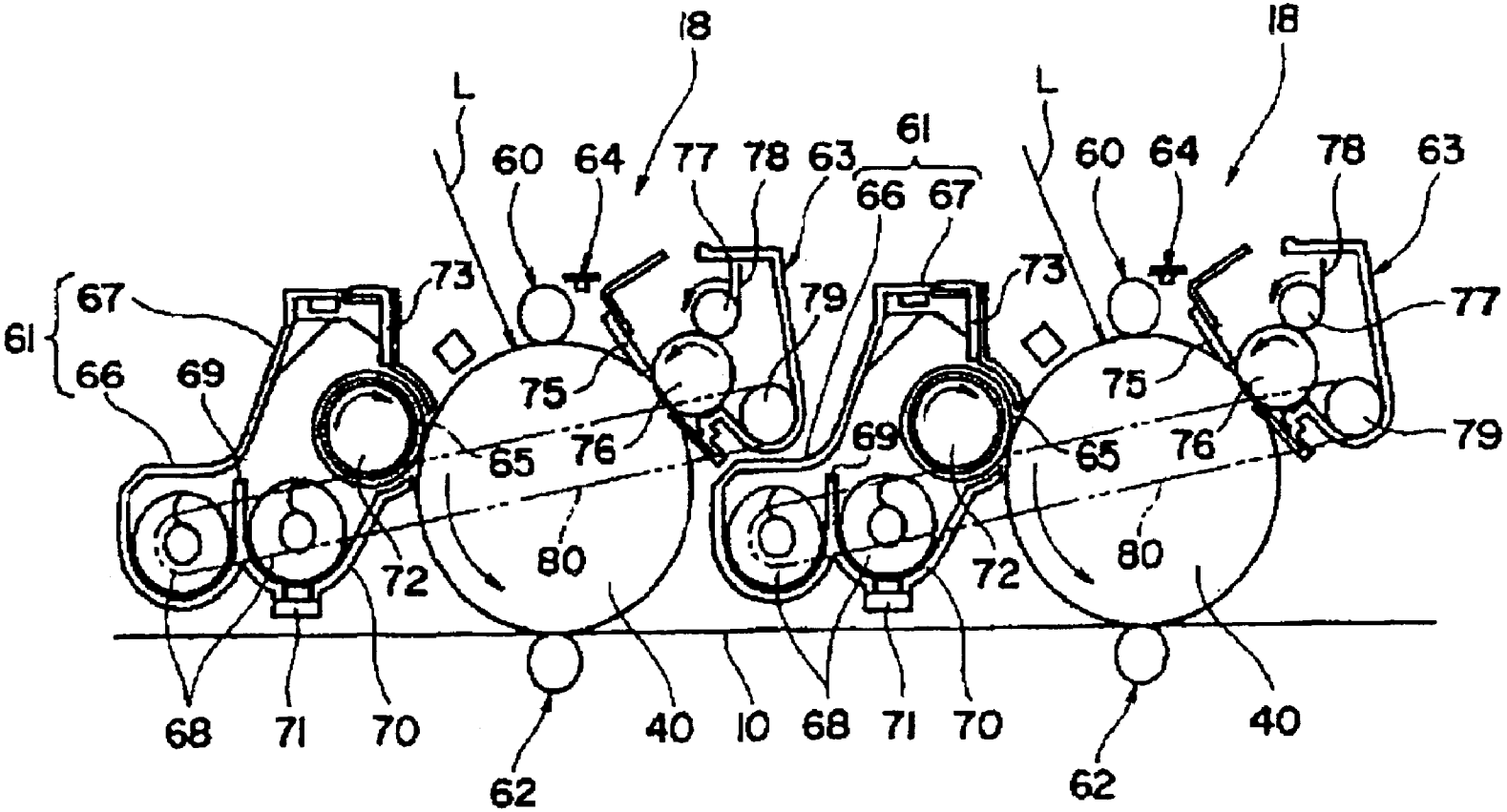
FIG. 6 shows image forming means included in the image forming apparatus.

FIG. 6 shows the configuration of the individual image forming means 18 specifically. As shown, the image forming means 18 includes a charger 60, a developing device 61, a primary image transferring device 62, a drum cleaner 63 and a quenching lamp or discharger 64 arranged around the drum 40. The drum 40 is made up of a tube formed of, e.g., aluminum and a photoconductive layer formed on the tube and implemented by OPC (Organic PhotoConductor). The drum 40 may be replaced with an endless, photoconductive belt, if desired.

Part of or the entire image forming means 18, including at least the drum 40, may be constructed into a process cartridge removably mounted to the copier body 100, so that the image forming means 18 can be easily maintained.

In the illustrative embodiment, the charger 60 included in the image forming means 18 is implemented as a charge roller configured to charge the drum 40 in contact therewith. Of course, the charger 60 may be implemented by a scorotron charger spaced from the drum 40.

Figure 7:
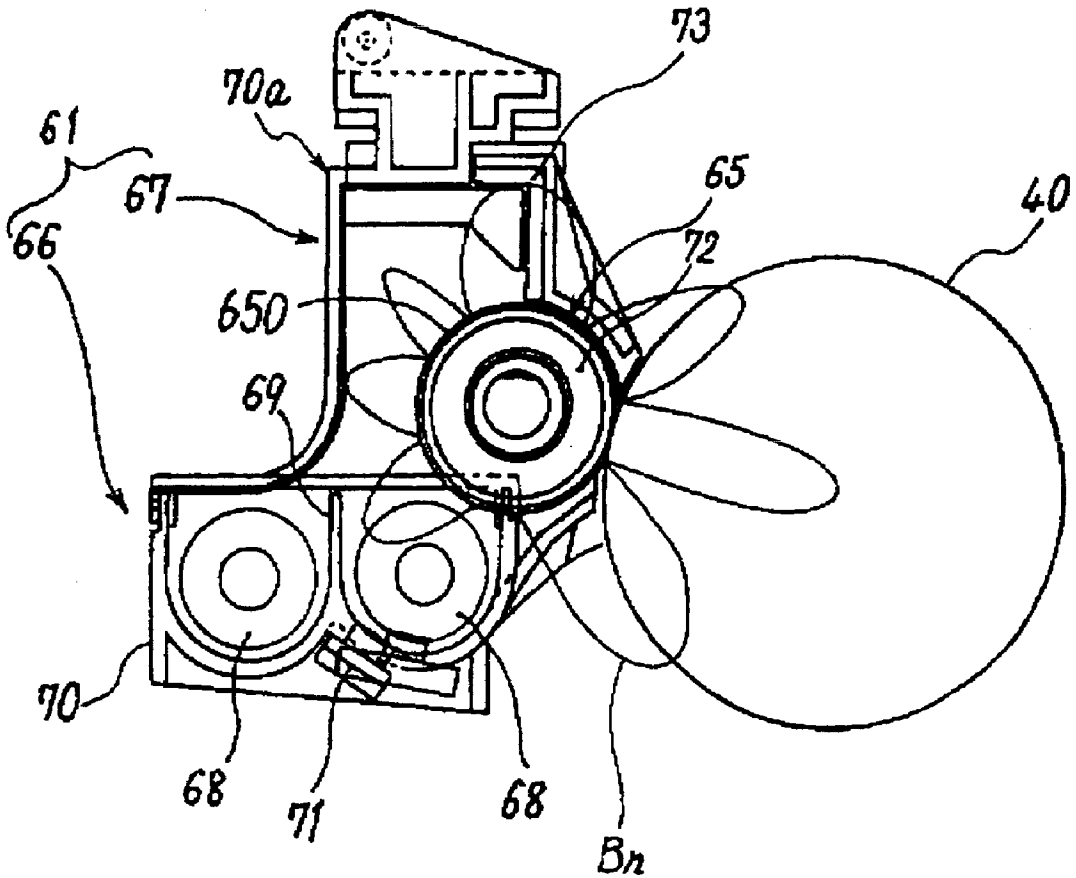
FIG. 7 shows a developing device with which the illustrative embodiments of the present invention are practicable.

Reference will be made to FIG. 7 for describing the developing device 61 in detail. As shown, the developing device 61 includes a developing roller 65, a screw or agitating and conveying member 68, a doctor or metering member 73, a case 70, and a cover 70*a*. The developing device 61 uses a two-ingredient type developer, i.e., a mixture of magnetic carrier and nonmagnetic toner. The developing device 61 is generally made up of an agitating section 66 for conveying the developer to the developing roller 65 while agitating it and a developing section 67 for transferring only the toner of the developer deposited on the roller 65 to the drum 40. The agitating section 66, positioned at a lower level than the developing section 67, accommodates two parallel screws 68 separated from each other by a partition 69. A toner content sensor 71 responsive to the toner content of the developer is mounted on the case 70.

In FIG. 7, curves Bn are representative of flux density distributions tangential to the surface of a sleeve 650, which forms part of the developing roller 65.

Figure 8:
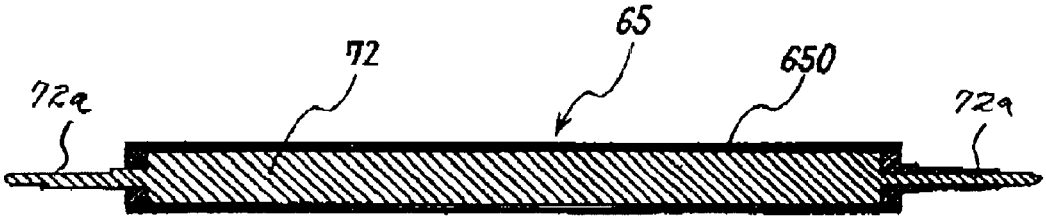
FIG. 8 is a section showing a developing roller included in the developing device of FIG. 7.
Figure 9:
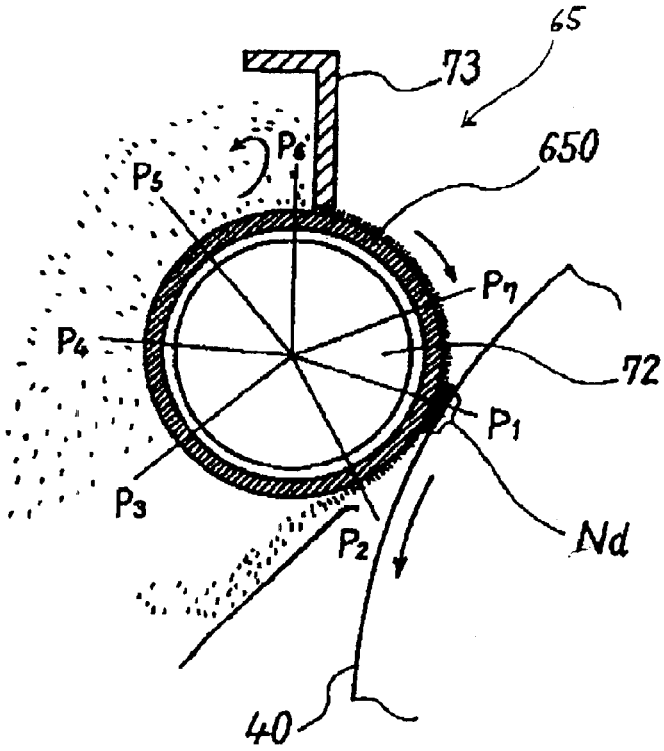
FIG. 9 shows the behavior of a developer around the developing roller.

The developing roller 65 faces the drum 40 via an opening formed in the case 70. As shown in FIGS. 8 and 9, the developing roller 65 includes a magnet roller or magnetic field generating means 72 and the sleeve or developer carrier 650. The magnet roller 72 is held stationary inside the sleeve 650 via a shaft 72*a* and formed with a plurality of magnetic poles at preselected angular positions. The magnetic forces of such magnetic poles, which act on the developer at preselected positions, allow the sleeve 650 in rotation to convey the developer deposited thereon. The arrangement of the poles of the magnet roller 72 and doctor 73 form a portion where the developer stays at the upstream side in the direction of developer conveyance, thereby promoting the frictional charging of the developer. A magnetic member, not shown, is mounted on the edge portion of the doctor 73 in order to uniform the directivity of the magnetic force of the pole facing the doctor 73, i.e., the amount by which the developer is conveyed.

More specifically, the magnet roller 72 has seven magnetic poles P1 through P7 by way of example. The magnetic poles P1 through P7 are sequentially arranged in this order from a position facing a developing zone in the direction of rotation of the sleeve 65. The magnet roller 72 causes the developer to form a magnet brush on the sleeve 650.

The two screws 68 feed the developer to the sleeve 650 while agitating and circulating it. The magnet roller 72 magnetically scoops up the developer to the sleeve 650 with the result that the developer deposits on the sleeve 650 in the from of a magnet brush. The magnet brush is conveyed by the sleeve 65 in rotation while being metered by the doctor 73 to form a thin layer on the sleeve 65. Excess part of the developer removed by the doctor 73 is returned to the agitating section 66.

A bias for development is applied to the sleeve 650. In this condition, the toner contained in the developer 650 is transferred from the sleeve 650 to the drum 40 and develops a latent image formed on the drum 40 for thereby producing a corresponding toner image. The developer left on the sleeve 650 after the development parts from the sleeve 650 at a position where the magnetic force of the magnet roller 72 does not act, returning to the agitating section 66. When the toner content of the developer present in the agitating section 66 decreases due to repeated development, fresh toner is replenished to the agitating section 66 in accordance with the output of the toner content sensor 71.

The primary image transferring device 62 is implemented as a charge roller although it may be implemented as a conductive brush or a corona charger. The charge roller is pressed against the drum 40 via the belt 10.

The drum cleaner 63 includes a cleaning blade 75 formed of, e.g., polyurethane rubber and having an edge pressed against the drum 40. A brush, contacting the drum 40, is used in combination with the cleaning blade 75 for enhancing cleaning ability. In the illustrative embodiment, the brush is implemented as a conductive fur brush 76 held in contact with the drum 40 and rotatable in a direction indicated by an arrow in FIG. 6. A metallic, electric field roller 77 applies a bias to the fur brush 76 and is rotatable in a direction indicated by an arrow in FIG. 6. A scraper 78 is held in contact with the electric field roller 77 at its edge. Further, a collection screw 79 collects the removed toner.

More specifically, the fur brush 76, rotating in the direction counter to the rotation of the drum 40, removes the toner left on the drum 40. The toner thus deposited on the fur brush 76 is removed by the electric field roller 77, which is applied with a bias and rotating in contact with the fur brush 76. Subsequently, the toner deposited on the electric field roller 77 is removed by the scraper 78. The toner so collected in the drum cleaner 63 is conveyed to one side of the drum cleaner 63 by the collection screw 79 and then returned to the developing device 61 by a toner recycling device 80.

The quenching lamp 64 initializes the surface potential of the drum 40 with light.

When the drum 40 starts rotating, the charger 60 uniformly charges the surface of the drum 40. The scanner 300 scans the charged surface of the drum 40 with light L, which issues from a laser or an LED (Light Emitting Diode) array, in accordance with image data derived from the output of the scanner 300, thereby forming a latent image on the drum 40.

Subsequently, the developing device 61 develops the latent image with toner for thereby producing a corresponding toner image. The toner image is then transferred from the drum 40 to the belt 10 by the charge roller 62. After the image transfer, the drum cleaner 63 removes toner left on the drum 40, and then the quenching lamp 64 discharges the surface of the drum 40 to thereby prepare it for the next image formation.

Figure 10:
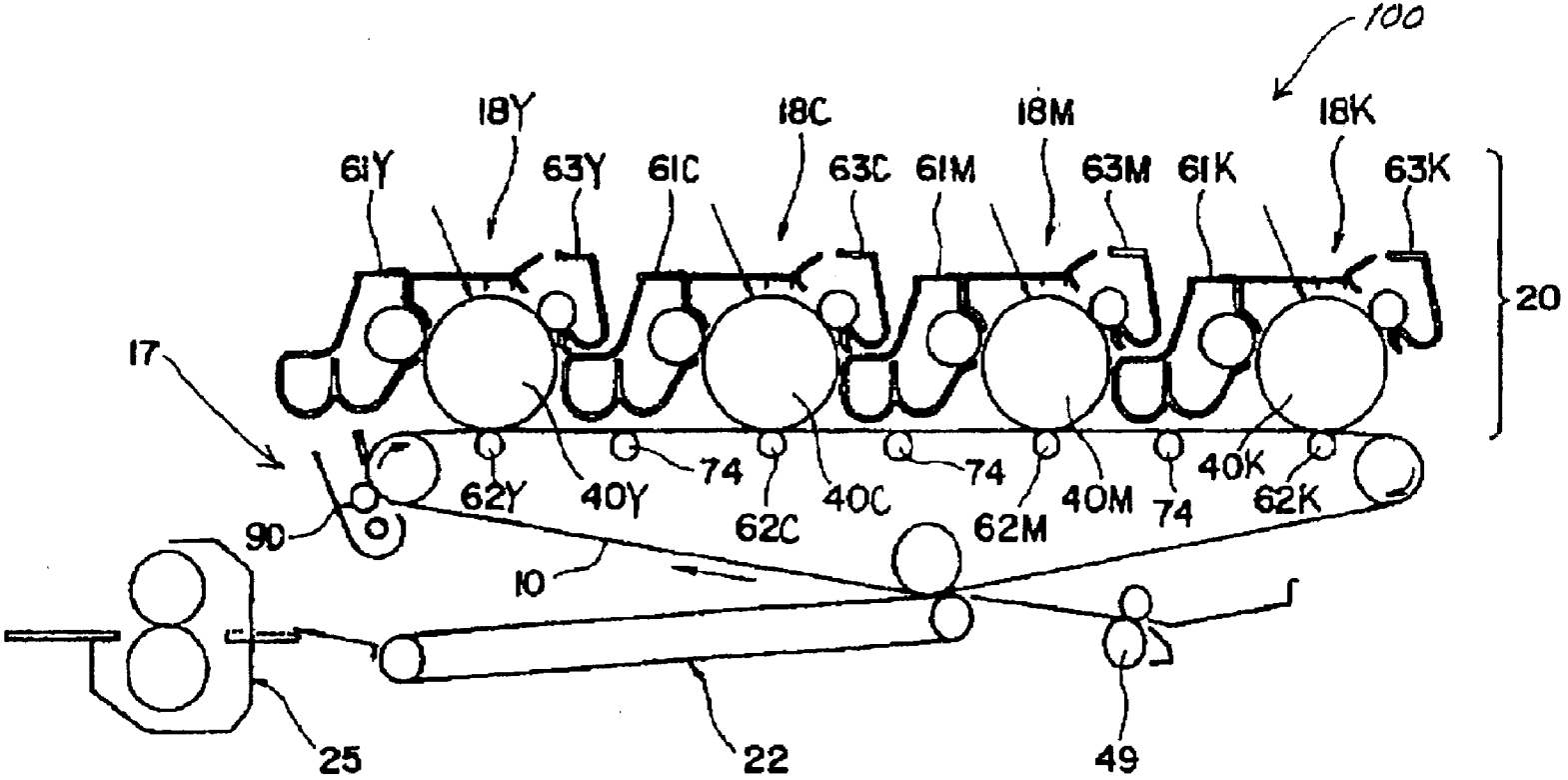
FIG. 10 is a fragmentary enlarged view of the image forming apparatus.

FIG. 10 shows the copier body 100, FIG. 4, in an enlarged scale. In FIG. 10, the structural elements of the four image forming mans 18K through 18Y, which are identical in configuration with each other, are simply distinguished from each other by suffixes K through Y. As shown, the copier body 100 includes conductive rollers 74, not shown in FIG. 4 or 6, each being held in contact with the base layer or inner surface of the belt 10 between nearby primary image transferring devices 62. The conductive rollers 74 prevent a bias applied to the primary image transferring devices 62 during image transfer from flowing into the image forming means 18 via the base layer of the belt 10, which has medium resistance.

The belt cleaner 17 includes a fur brush or cleaning member 90 to which a preselected bias is applied from a power supply not shown.

Figure 11:
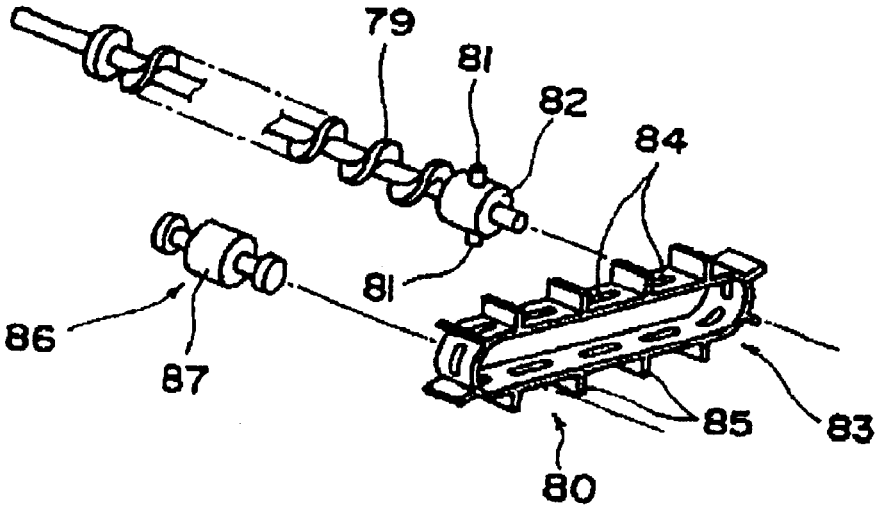
FIG. 11 is a fragmentary enlarged view showing a toner recycling device.
Figure 12:
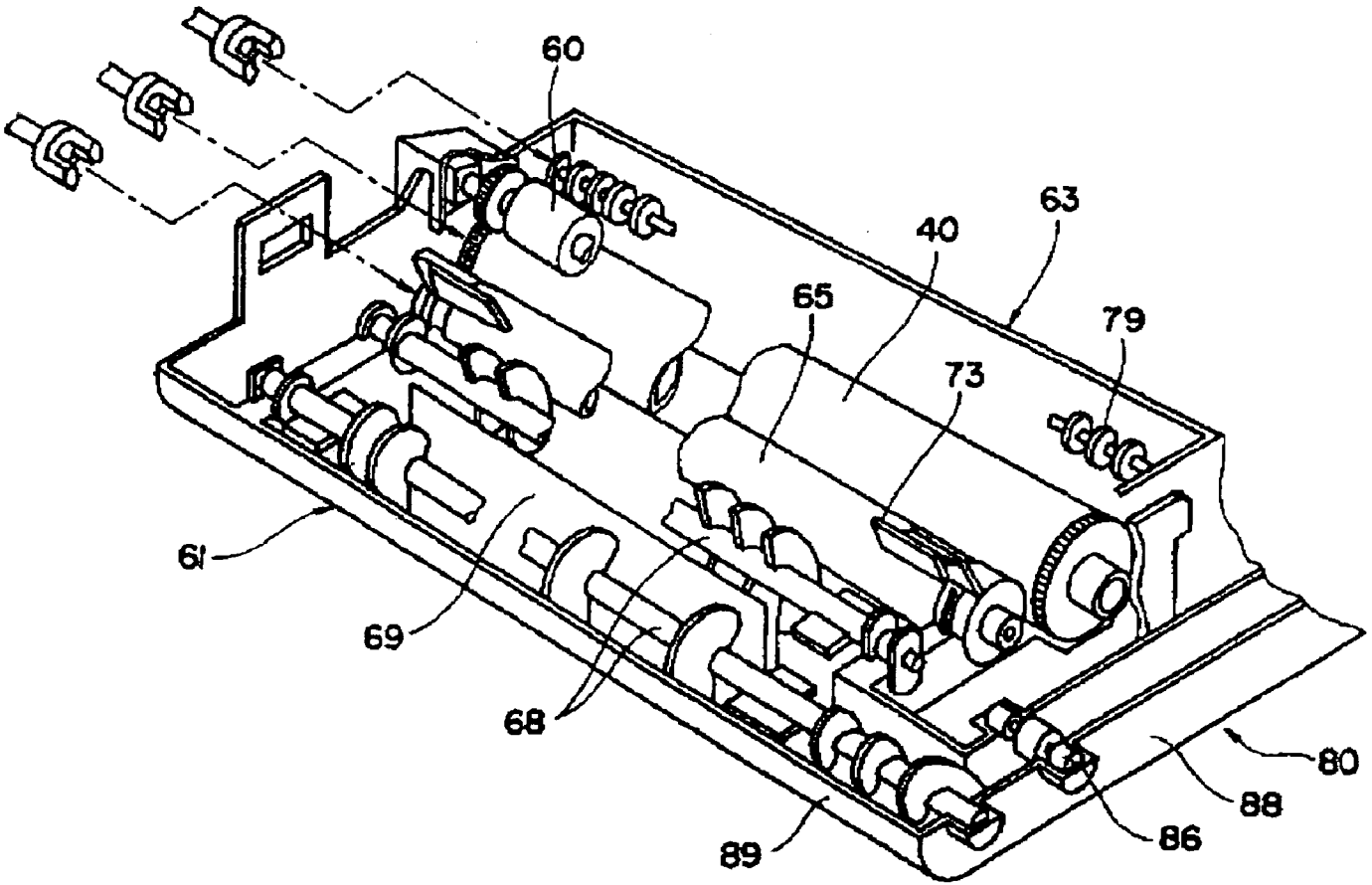
FIG. 12 is a perspective view of the toner recycling device.

FIGS. 11 and 12 show a specific configuration of the toner recycling device 80. As shown in FIG. 11, one end of the collection screw 79, included in the drum cleaner 63, is configured as a roller portion 82 on which pins 81 are studded. A toner conveying member 83, implemented as a belt, is passed over the roller portion 82 at one side with slots 84 thereof receiving the pins 81. Blades 85 are positioned on the outer surface of the toner conveying member 83 at preselected intervals. The other side of the toner conveying member 83 is passed over a roller portion 87 included in a rotatable shaft 86.

As shown in FIG. 12, the toner conveying member 83 is accommodated in a case 88 together with the rotatable shaft 86. The case 88 is constructed integrally with a cartridge case 89. One of the two screws 68, included in the developing device 61, is mounted on one edge portion of the case 88 close to the developing device 61.

When the collection screw 79 is rotated by a drive force transferred thereto from the outside, the screw 79 causes the toner conveying member 83 to move and convey the toner, collected by the drum cleaner 63, to the developing device 61 via the case 88. Subsequently, the screw 68 mounted on the case 88 delivers the toner into the developing device 61. Thereafter, the two screws 60 circulate the toner while agitating it together with the developer present in the developing device 61. The resulting mixture is fed to the sleeve 650, metered by the doctor 73 and then transferred to the drum 40, as stated earlier.

The toner grains and carrier grains or magnetic grains, constituting the two-ingredient type developer, will be described in detail hereinafter. To produce toner grains, a charge control agent (CCA) and a colorant are mixed with polyester, polyol, styrene-acryl or similar resin, and then silica, titanium oxide or similar substance is coated on the individual grain for enhancing chargeability and fluidity. The grain size of additives usually lies in the range of from 0.01 $\mu$m to 1.5 $\mu$m. For the colorant, use may be made of carbon black, Phthalocyanine Blue, quinacrydone or carmine by way of example. In the illustrative embodiment, the toner grains are chargeable to negative polarity.

The additives mentioned above may be coated on the toner grains in which wax, for example, is dispersed while the toner grains are assumed to be produced by pulverization, they may alternatively be produced by, e.g., polymerization. Generally, toner grains produced by, e.g., polymerization or heating can have a shape factor of 90% or above and can be coated with additives in a high ratio.

The volumetric mean grain size of toner grains should preferably be between 3 $\mu$m and 12 $\mu$m. In the illustrative embodiment, the volumetric mean grain size is selected to be 6 $\mu$m that can sufficiently cope with resolution as high as 1,200 dpi (dots per inch) or above.

The carrier grains each consist of a metal or resin core, containing ferrite or similar magnetic substance, and a silicone resin or similar surface layer coated on the core. The carrier grains should preferably have a grain size ranging from 20 $\mu$m to 50 $\mu$m and resistance ranging from $10^4$ Ω to $10^6$ Ω in terms of dynamic resistance. To measure the resistance, the carrier grains are deposited on a roller accommodating a magnet therein and having a diameter of 20 cm and rotated at 600 rpm (revolutions per minute), and a 60 mm wide, 1 mm long electrode is spaced from the roller by a gap of 0.9 mm. In this condition, an upper limit voltage, which is 400 V in the case of grains coated with high-resistance silicone or several volts in the case of iron-powder grains, is applied.

Figure 13:
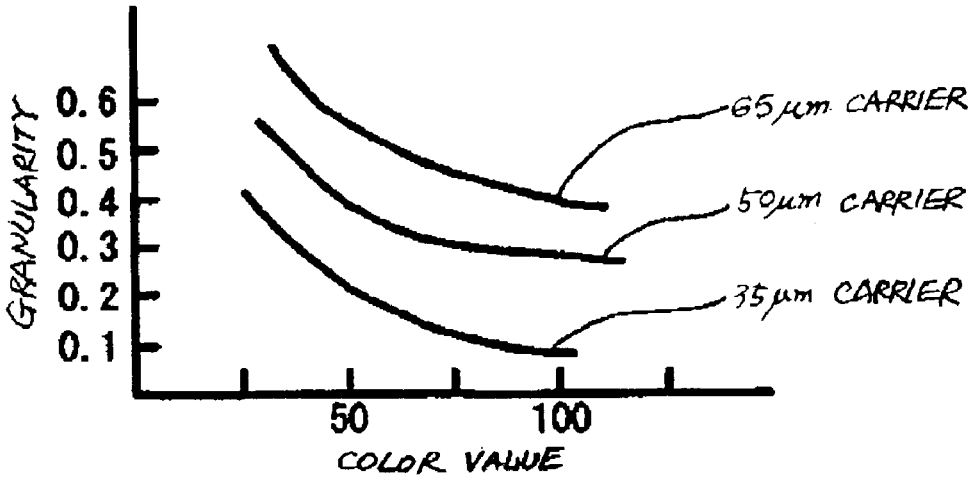
FIG. 13 is a graph showing a relation between the grain size of magnetic carrier grains included in a developer and the granularity of an image.

The grain size of the carrier should preferably be reduced to noticeably enhance image quality. For example, while a carrier grain size of 50 $\mu$m or above cannot improve granularity above 0.3 or so as for a halftone dot image having a color value of 60 to 90, a carrier grain size of about 35 $\mu$m improves granularity to 0.1, i.e., by almost three times, as shown in FIG. 13.

Figure 14:
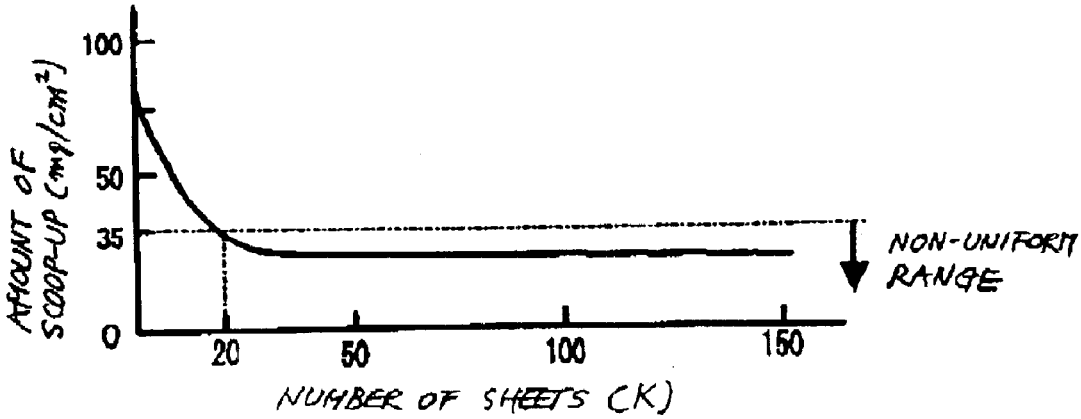
FIG. 14 is a graph showing how the amount of the developer to be scooped up to a sandblasted sleeve decreases.

Also, to maintain image quality constant, it is necessary to stabilize the amount ρ by which the developer is scooped up, or conveyed via the doctor 73, and to reduce the deterioration of the developer The amount ρ and deterioration are noticeably influenced by the magnetic force distribution of the pole of the magnet roller 72 facing the doctor 73, the surface configuration of the sleeve 650, and the surface configuration of the developer. More specifically, as shown in FIG. 14, the amount ρ decreases due to the wear of the sleeve 650 and developer ascribable to aging, rendering an image non-smooth.

Figure 15:
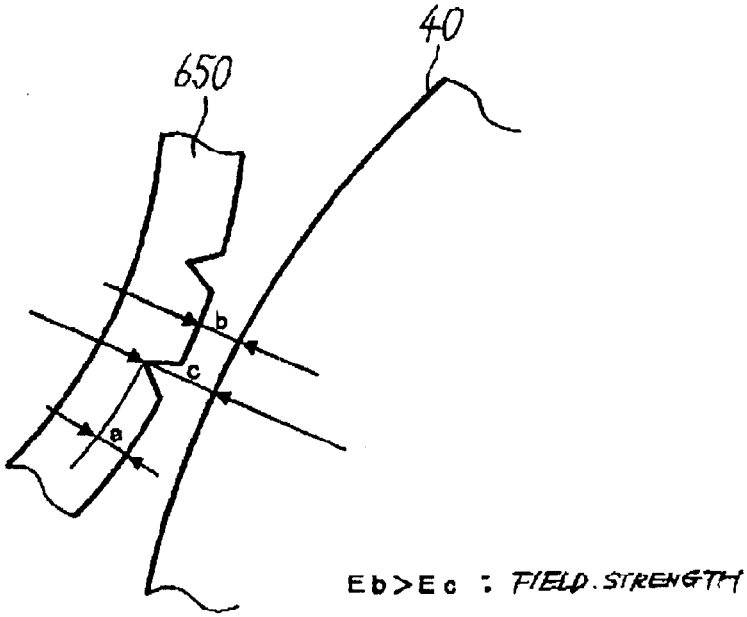
FIG. 15 is an enlarged view of a developing zone.
Figure 16:
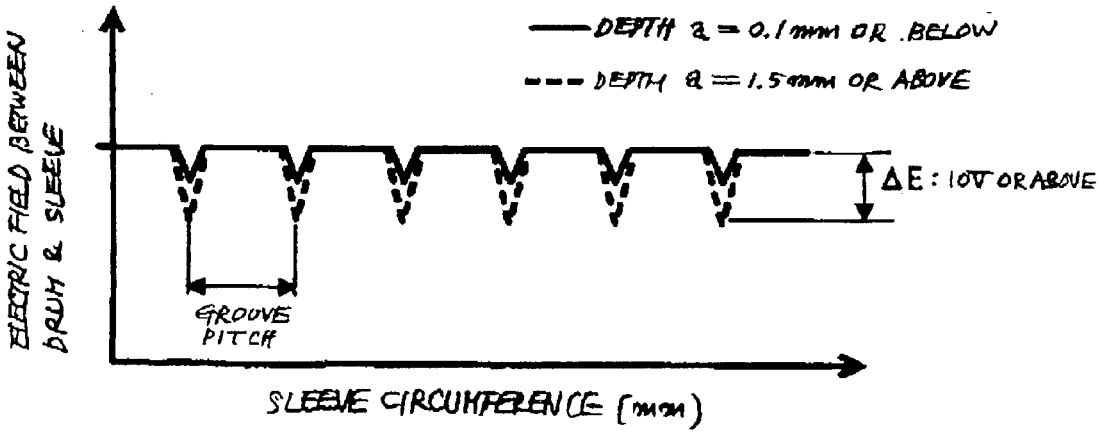
FIG. 16 is a graph showing how an electric field in the developing zone varies.

The surface of the sleeve 650 is usually formed with grooves extending in the axial direction of the sleeve 650 at spaced locations along the circumference of the sleeve 650 or is roughened by sandblasting. However, as shown in FIGS. 15 and 16, the problem with the sleeve 650 formed with grooves is that the distance between the sleeve 650 and the drum 40 varies from a portion where the groove is formed to a portion where it is not formed. For example, as shown in FIG. 16, when the depth a of each groove is 0.15 mm or above, the electric field for development varies by 10 V or more in terms of the variation of surface potential. As a result, pitch irregularity or banding, corresponding to the pitch of the grooves 650*a*, appear in an image, as shown in FIGS. 15 and 16. For this reason, sandblasting is predominant over the groove scheme. Even sandblasting, however, has a problem that the surface roughness of the sleeve 650 decreases due to repeated image formation or that the amount ρ of scoop-up decreases due to the wear of the coating layers of the developer grains.

Further, even if granularity is improved by using the carrier grains with a small grain size, the improvement is canceled by the non-smoothness of an image ascribable to a decrease in the amount ρ of scoop-up derived from the wear of the coating layers of the developer grains. The fall of the developer conveying ability ascribable to such wear becomes more conspicuous as the rotation speed of the sleeve 650 becomes higher, as in the illustrative embodiment, because wear is more aggravated. A solution to this problem is a key to a future high speed, high image quality machine.

In light of the above, in the illustrative embodiment, the surface of the sleeve 650 is provided with the following configuration in order to reduce the fall of the developer conveying ability stated above. Assuming that the sleeve 650 has an outside diameter of a and formed with n grooves 650*a*, that the drum 40 rotates at a linear velocity of Vp, and that the sleeve 650 rotates at a linear velocity of Vs, then the surface of the sleeve 650 is configured to satisfy the following relations:

$$\text{pitch on image}=a\alpha Vp/nVs\leqq 0.5\ (\text{mm})$$

$$n\geqq a\alpha Vp/(0.5Vs) \quad (1)$$

Figure 17A:
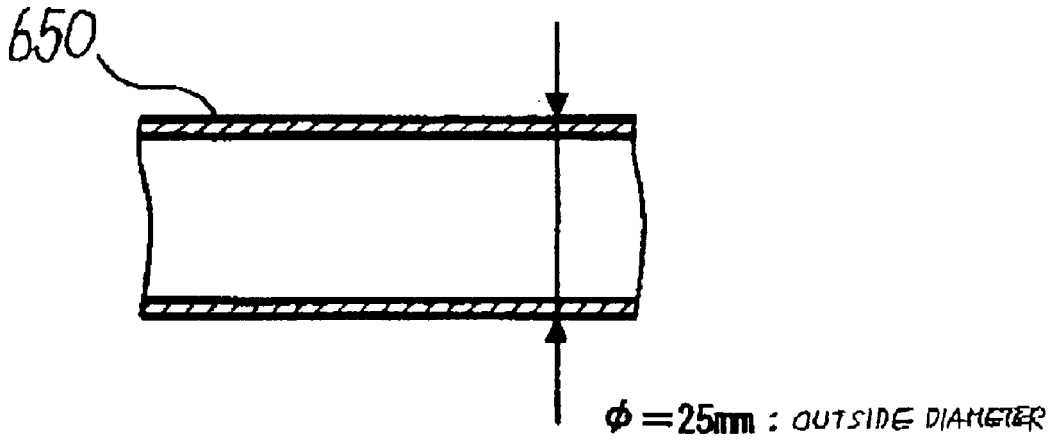
FIGS. 17A and 17B are sections showing a developing sleeve.
Figure 17B:
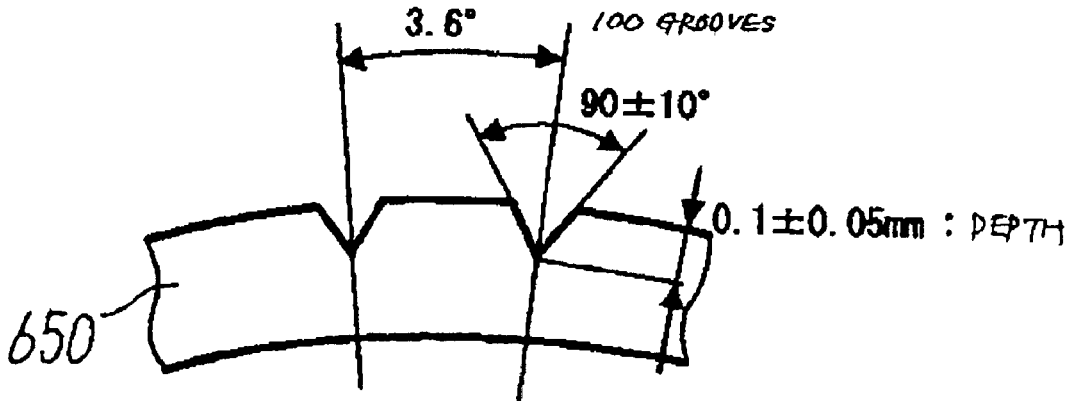

The number of grooves 650*a*, satisfying the above relations (1), allows the pitch on an image corresponding to the grooves 650*a* to be confined in a banding range of 0.5 mm or below difficult to see by eye, as determined by experiments (see FIGS. 17A and 17B). More specifically, when the outside diameter a of the sleeve 650 is 25 mm and when the linear speed ratio Vs/Vp is 2, the sleeve 650 is formed with 100 grooves 650*a* so as to implement the above banding range. In this specific condition, the relations (1) are satisfied as follows:

$$(25\times n)/(100\times 2)\approx 0.39<0.5\ (\text{mm})$$

Further, fine pitch irregularity or banding is blurred by the width of a nip Nd (see FIG. 9) implemented by magnet brush development and is therefore inconspicuous. By so satisfying the condition relating the number of grooves and making each groove 0.1 mm deep or less, it is possible to reduce the variation of the electric field for development. In addition, by providing each groove with a V-shaped cross-section, it is possible to provide the variation of the electric field with a gradient having a pin-point maximum value, thereby making the above irregularity more inconspicuous.

Figure 18:
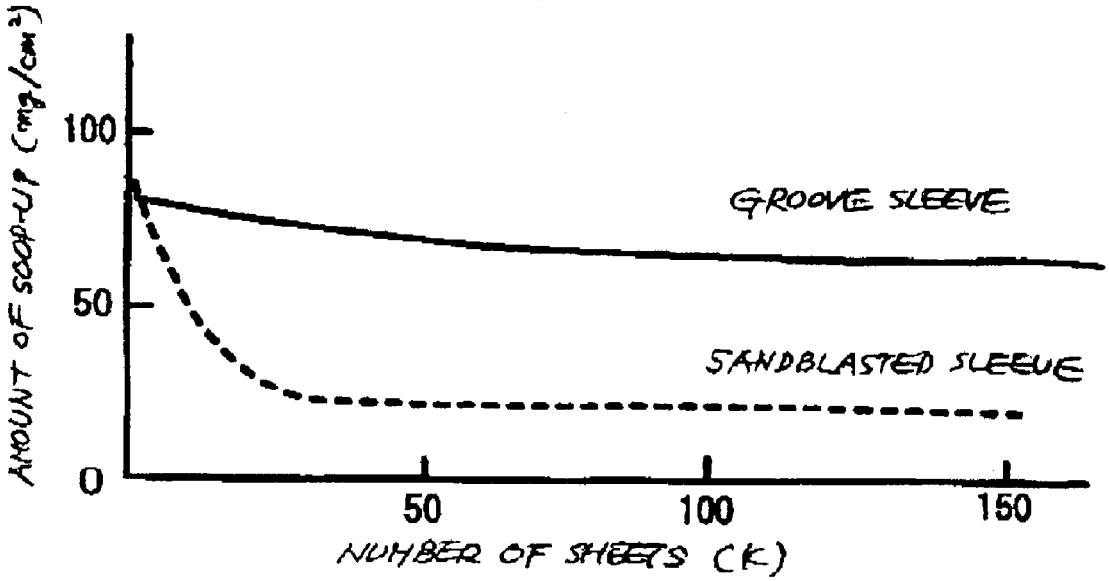
FIG. 18 is a graph showing how the amount of the developer to be scooped up to V-shaped grooves varies.
Figure 19:
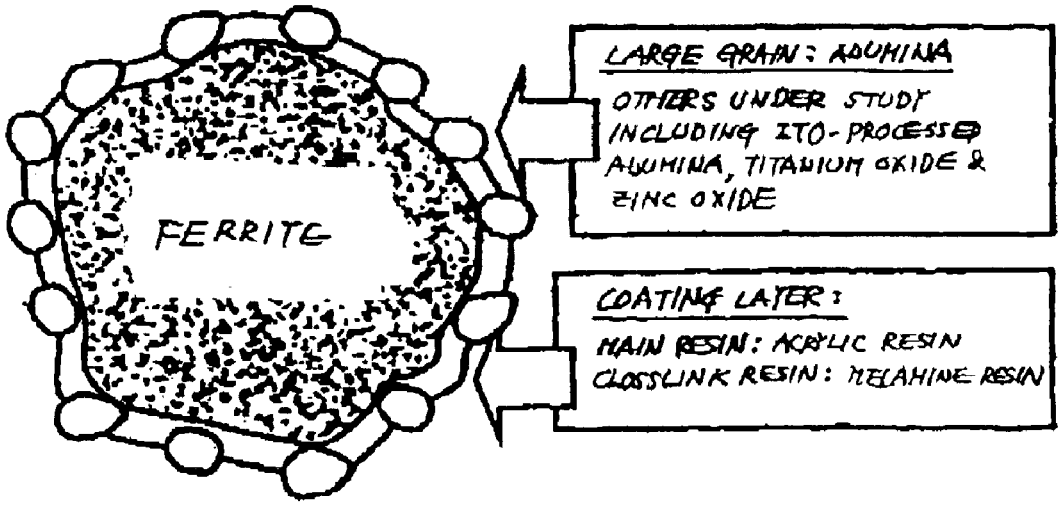
FIG. 19 shows a single magnetic carrier grain.

As shown in FIG. 18, when the sleeve 650 formed with the above grooves was used, the developer conveying ability available with the grooves was successfully improved to reduce a decrease in the amount ρ of scoop-up ascribable to the wear of the coating layers of the developer grains.

The fall of developer conveying ability ascribable to the wear of the coating layers can be improved, as stated above. Further, by obviating the above wear, it is possible to realize an ideal, ultra-stable range in which the amount ρ of scoop-up does not vary at all. Carrier grains have heretofore been developed under the notion of extending the life by shaving off hard coating layers little by little. By contrast, the illustrative embodiment extends the life of the carrier grains, i.e., free the carrier grains from shave-off and spent by well balancing the following two effects (1) and (2):

(1) providing the carrier grains with elasticity to thereby absorb impacts and reduce shave-off, and using highly adhesive coating layers to thereby retain large grains; and (2) causing carrier surfaces to contain grains larger than the coating layers to thereby protect the coating layers from impacts and remove spent substances.

Figure 20:
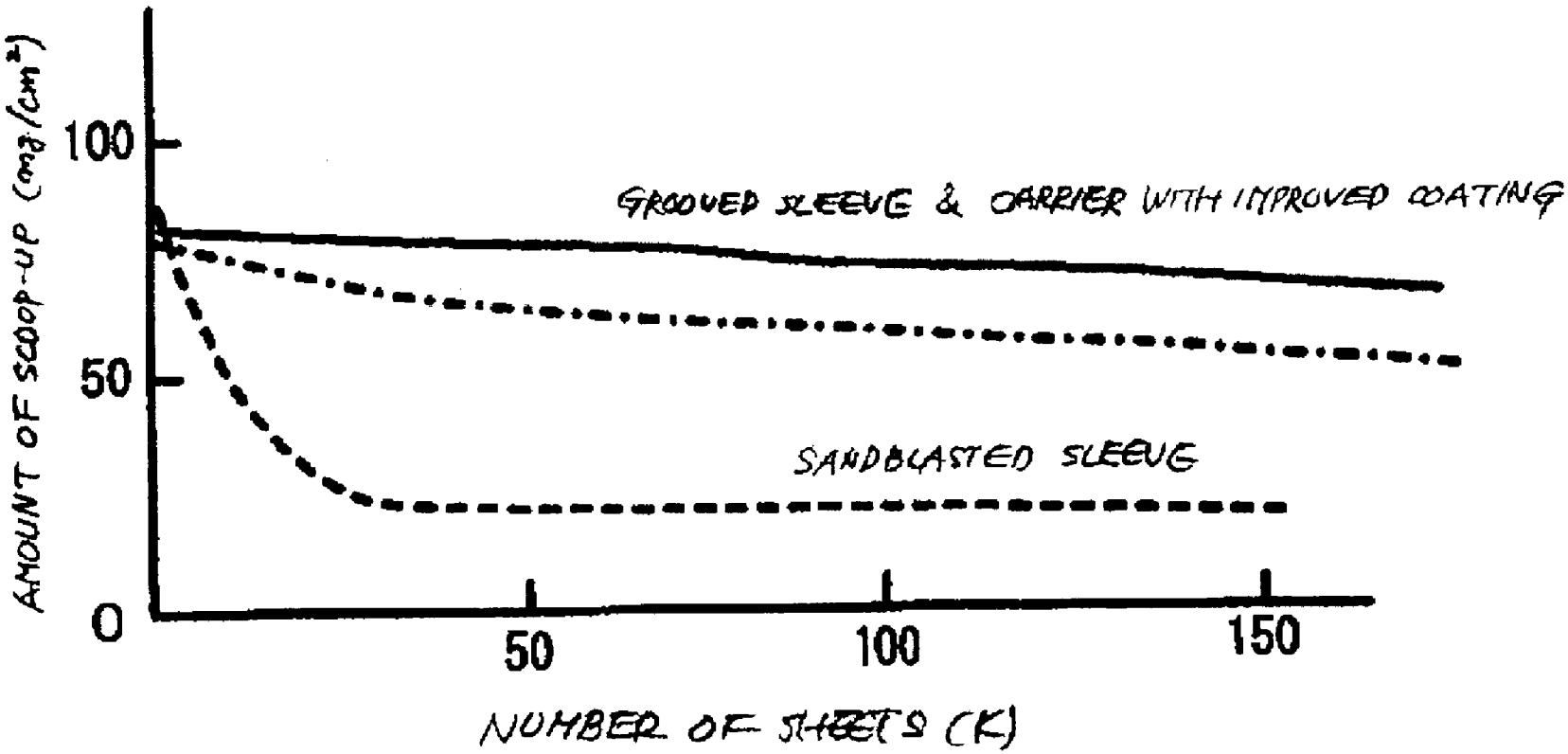
FIG. 20 is a graph showing how the amount of the developer to be scooped up on the sleeve formed with the V-shaped grooves varies when use is made of carrier grains with improved coating layers.

The above carrier grains each consist of a ferrite core and a coating layer in which a charge control agent is contained in a resin component produced by the crosslinking of acrylic resin or similar thermoplastic resin and melamine resin. As shown in FIG. 20, when such a developer whose carrier is free from shave-off was used in combination with the sleeve formed with a particular number of V-shaped grooves, a developing device achieving both of high operation speed and high image quality could be realized.

Now, portions characterizing the illustrative embodiment will be described specifically hereinafter.

The sleeve 650 with the V-shaped grooves insures stable conveyance of the developer. However, if such stable conveyance is guaranteed even at opposite end portions of the sleeve 650 in the axial direction, then the magnetic force of the magnet roller 72 concentrated at the opposite end portions causes the developer to flow into the end portions of the image forming range of the sleeve 650. As a result, developer density at the opposite end portions of the nip for development increases, causing the pressure of the developer to increase between the surface of the drum 40 and that of the sleeve 650 at the opposite end portions. In this condition, the developer is apt to adhere to or drop from the opposite end portions of the sleeve 650. The developer adhered to the sleeve 650 critically damages the image forming apparatus by bringing about the peeling of the surface layer of the drum 40, an image smeared at opposite edge portions, a banding image ascribable to drive load, and defective cleaning. Such a phenomenon is accelerated due to the decreasing grain size and decreasing gap Gd for development.

Figure 21:
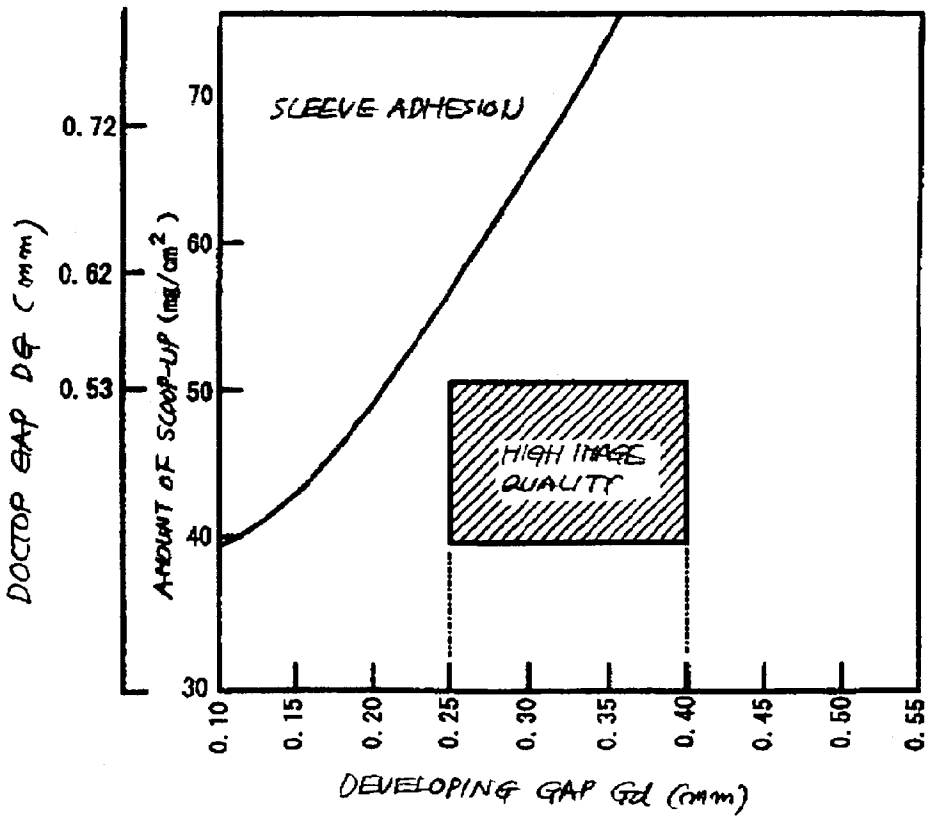
FIG. 21 shows a high image quality range and a sleeve adhesion range to occur when a gap for development and the amount of scoop-up (doctor gap) are varied.

FIG. 21 shows a high image quality range and a sleeve adhesion range determined by varying the gap Gd for development and the amount ρ of scoop-up (doctor gap). As shown, when the gap Gd is reduced to 0.4 mm or below, not only an image with noticeable granularity is obviated, but also the omission of portions around characters and the omission of a trailing edge ascribable to a DC bias are reduced. However, when the gap Gd is reduced, the upper limit of the amount ρ that prevents the developer from adhering to the opposite end portions of the sleeve 650 drops little by little. Further, when the gap Gd is reduced, a margin as to the adhesion of the developer to the opposite end portions of the sleeve decreases due to an error in the accuracy of the doctor gap, so that the developer is apt to adhere to the sleeve.

Figure 22:
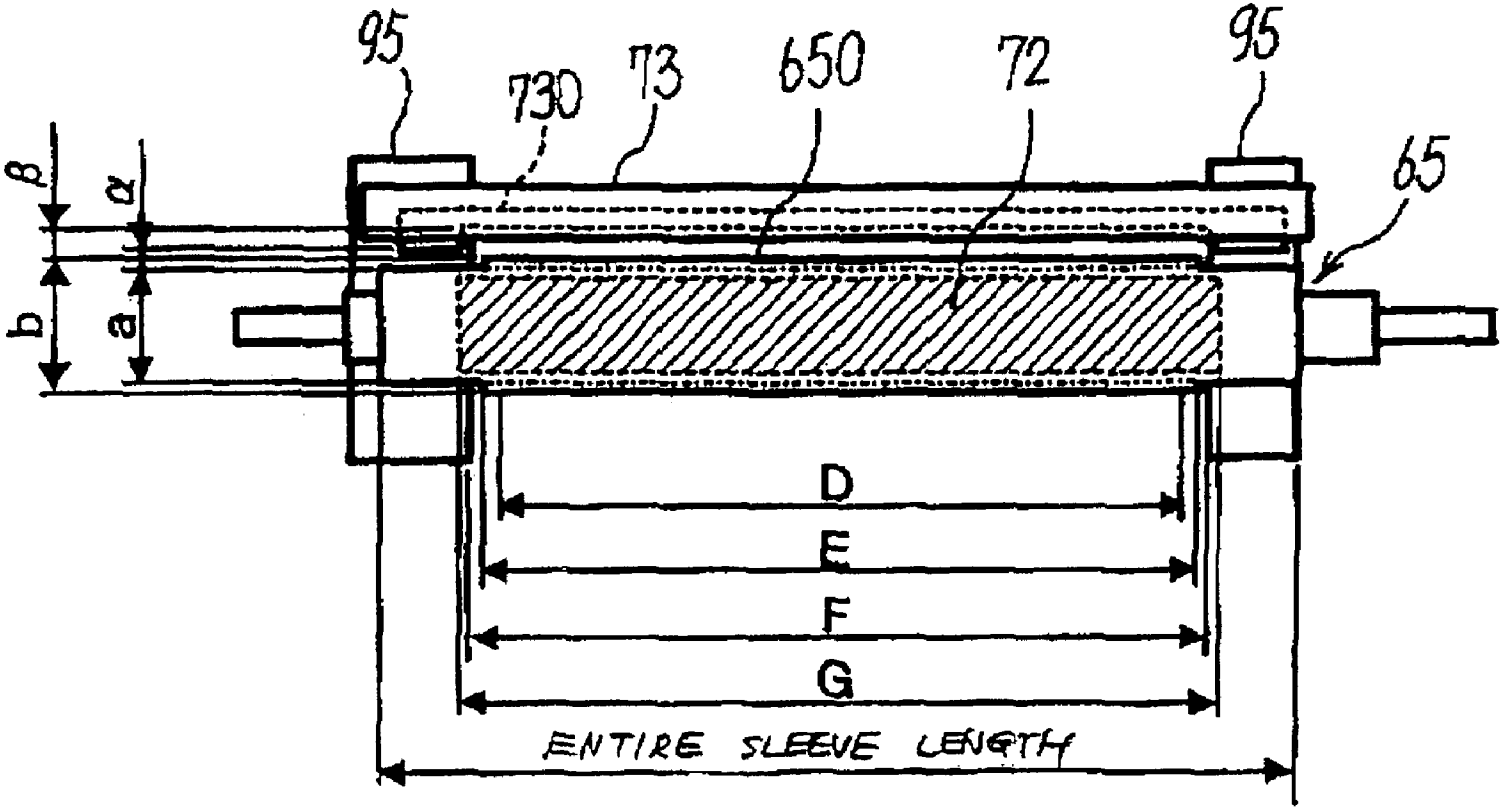
FIG. 22 shows a positional relation between the image forming range and groove range of the sleeve included in the first embodiment, a magnet roller, a magnetic plate, and side walls including in a casing member.

FIG. 22 shows specific configurations unique to the illustrative embodiment and capable of regulating the conveyance of the developer at the opposite end portions of the sleeve 650. The magnetic force of the magnet roller 72 is higher at opposite end portions of the sleeve 650 than at the other portion due to leaked magnetic fields and is therefore apt to convey a large amount of developer. If the sleeve 650 formed with the V-shaped grooves is used in such a condition, then the amount of the developer being conveyed increases at the opposite end portions. In light of this, the illustrative embodiment uses the following unique configurations (1) through (3).

(1) The center portion of each V-shaped groove (groove portion hereinafter) is extended over a range that guarantees the width of the image forming range D, i.e., to the outside of the image forming range D. More specifically, as shown in FIG. 22, the width E of the center portion or groove portion is selected to be smaller than the width D of the image forming range, i.e., E>D is selected. The V-shaped groove is therefore absent at the opposite end portions outside of the center portion E, so that the conveying ability is lowered at the opposite end portions. To form such non-groove portions at the opposite ends, an aluminum tube may be drawn to form the V-shaped grooves, and then opposite end portions of the tube may be ground by the depth of the grooves. In the illustrative embodiment, the non-groove portions are provided with surface roughness Rz (ten-point mean roughness) of 5 μm or below so as to further lower the conveying ability at the opposite end portions. More preferably, the surface roughness Rz should be 1 μm or above. This range of surface roughness can be implemented by grinding instead of by polishing and therefore at low cost.

Further, opposite ends of the pole P6 provided on the magnet roller 72 face the opposite non-groove portions of the sleeve 650. More specifically, as shown in FIG. 22, the length G of the pole P6 is larger than the width E of the center portion of V-groove portion, i.e., G>E is satisfied. In this configuration, the peaks of the magnetic force in the direction tangential to the surface of the sleeve 650, concentrating at opposite ends, face the non-groove portions of the sleeve 650 where the developer conveying ability is relatively low. Therefore, even when the developer is urged by the concentrated electric fields toward the opposite end portions of the sleeve 650, the amount of developer does not increase more than when the magnetic field concentrates at the center portion or groove portion.

(2) A magnetic plate 730 is mounted on the upstream surface of the doctor 73 in the direction of developer conveyance and constitutes a magnetic member to be magnetized by the magnet roller 72. Opposite end portions of the magnetic plate 730 are protruded toward the sleeve 650 in correspondence to the opposite non-groove portions of the sleeve 650, thereby preventing the developer from flowing into the opposite end portions with magnetic restraint.

Figure 23:
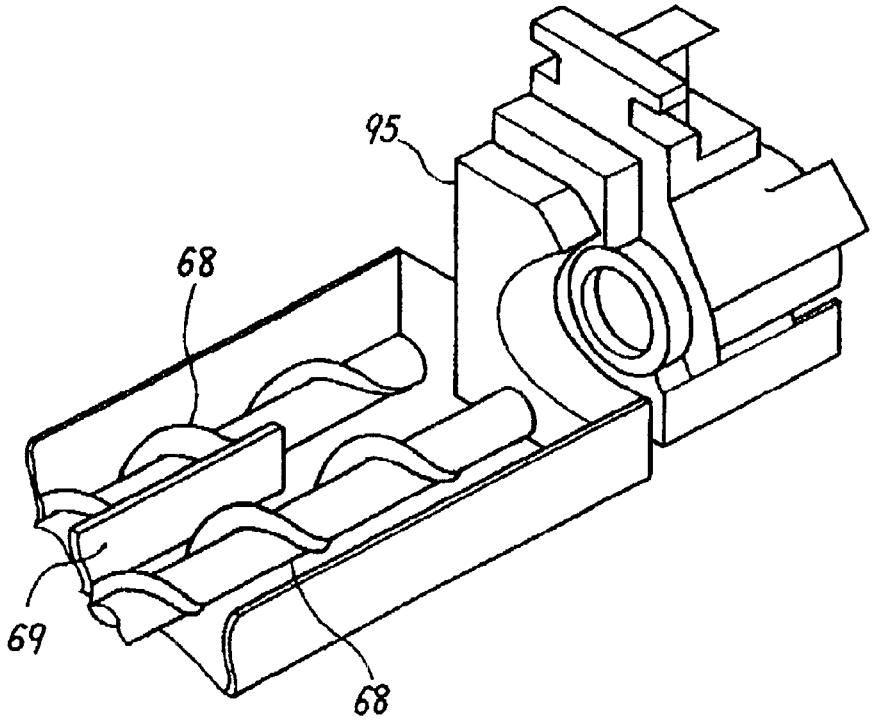
FIG. 23 shows one of the side walls of the casing member.

(3) As shown in FIG. 23, the casing member for development includes opposite side walls 95. The side walls 95 each are so positioned as to overlap one end of the magnet roller 72 by 1 mm in the axial direction of the sleeve 650. In this condition, as shown in FIG. 22, the following relation holds between the distance F between the opposite side walls 95 and the width E of the center or groove portion of the sleeve, the width D of the image forming range and the length G of the pole of the magnet roller 72:

$$G>F\geqq E>D$$

With the above relation, the side walls 95 can surely regulate the scoop-up of the developer at the opposite ends.

Figure 24:
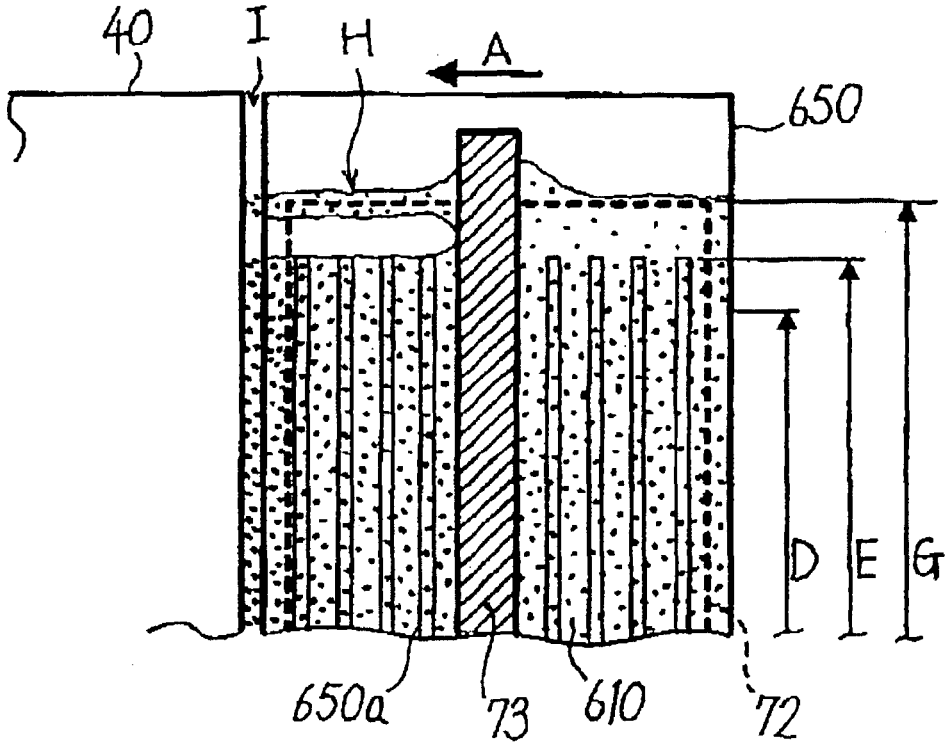
FIG. 24 shows the movement of the developer around the end portion of the sleeve.

FIG. 24 demonstrates more specifically why the illustrative embodiment can prevent the amount of the developer 610, attracted by the concentrated magnetic field at the end portion of the sleeve, from increasing, compared to the case wherein the magnetic field concentrates at the center or groove portion of the sleeve. In this condition, it is possible to reduce, e.g., the adhesion of the developer to the sleeve 650 at the opposite end portions of the sleeve 650 ascribable to an increase in developer pressure in the developing zone I, while insuring stable conveyance in the image forming range D.

In the illustrative embodiment, the gap for development is selected to be 0.4 mm or below in order to obviate a granular image as well as the omission of portions around characters and the trailing edge of an image. More preferably, the above gap should be 0.25 mm or above. A gap less than 0.25 mm is apt to cause the developer pressure to excessively rise at the center portion of the sleeve 650 in the developing zone I due to the error of the doctor gap and that of the amount of scoop-up, the oscillation of the sleeve surface and that of the drum surface, resulting in, e.g., the adhesion of the developer to the center portion of the sleeve 650.

It is to be noted that the shape of the grooves formed in the sleeve 650 is not limited to "V", but may be replaced with any other shape, The illustrative embodiment is, of course, practicable with a sleeve whose center portion is roughened by sandblasting or formed with ridges extending in the axial direction.

Second Embodiment

A second embodiment of the present invention is directed mainly toward the second object stated earlier. Because FIGS. 2, 3, 7 through 9, 13, 14, 18 and 20 apply to the illustrative embodiment as well, the following description will concentrate only differences between the first and second embodiments.

Figure 25:
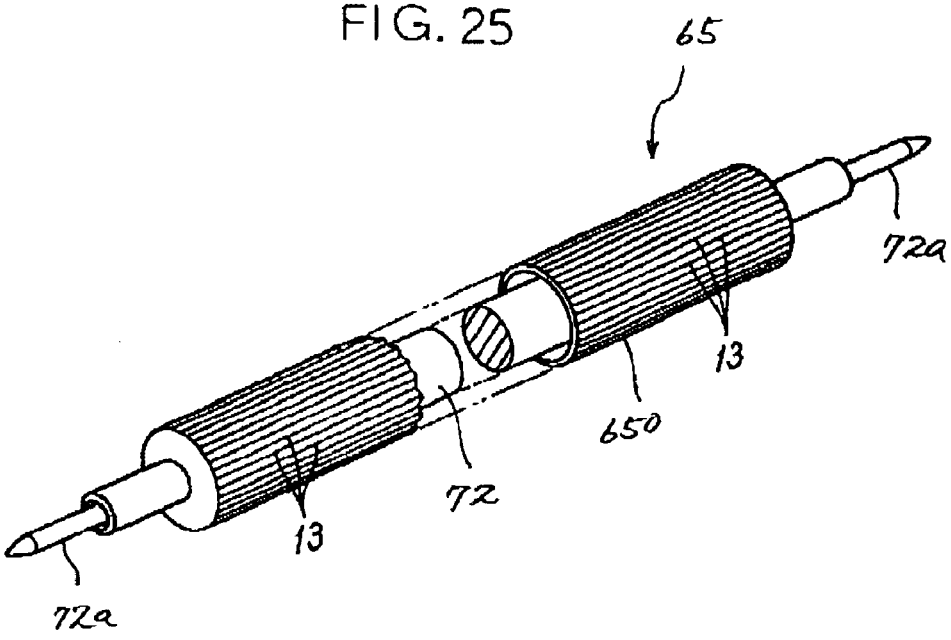
FIG. 25 is a perspective view showing a developing roller included in a second embodiment of the present invention.

The developing device shown in FIGS. 7 through 9 is required to satisfy the following conditions (1) through (3):

(1) stable scoop-up of the developer onto the developing roller (2) reduction of the size of the carrier grains (3) reduction of the deterioration of the developer To satisfy the condition (1), the developing roller 65 should preferably be formed with a plurality of axially extending grooves, so that the frictional resistance of the roller surface is increased. FIG. 25 shows a specific configuration of the developing roller 65 formed with such grooves. As shown, a plurality of grooves 13 are formed in the surface of the sleeve 650 in the axial direction, i.e., along the axis of the shaft 72*a*. The developing roller 65 allows a constant amount of developer to be stably scooped up thereon without regard to repeated development, as indicated by a solid curve in FIG. 18. By contrast, the developing roller 65 with the sleeve 650 subjected to sandblasting causes the amount of scoop-up to vary, as indicated by a dotted curve in FIG. 18, However, the problem with the sleeve formed with the grooves 13 is that banding, e.g., stripe-like irregularity appears in the resulting toner image, as stated earlier.

A first to a fourth specific examples of the illustrative embodiment to be described hereinafter are configured to solve the problem stated above. In the following description, structural elements identical with those shown in FIGS. 5 through 7 are designated by identical reference numerals and will not be described specifically in order to avoid redundancy.

<First Example>

Figure 26:
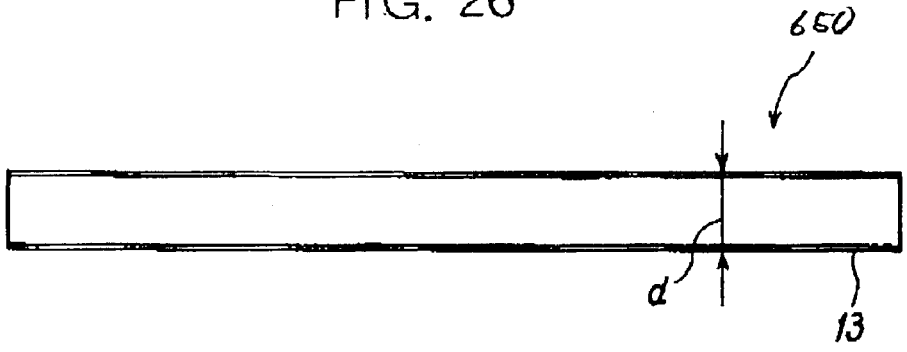
FIG. 26 is a section showing a sleeve forming part of the developing roller of FIG. 25.

In a first example, the developing device includes the following configuration in addition to the configurations of the developing device shown in FIGS. 5 through 7. In the first example, to reduce the variation of the developer conveying ability ascribable to the wear of the developing roller 65, the surface of the sleeve 650 is provided with the following configuration. Assume that the circumferential length of the surface of the sleeve 650 is L. Then, assuming that the sleeve 650 has an outside diameter d, and that the ratio of the circumference of a circle to its diameter is π, there holds $L=d\pi$ (see FIG. 26). Further, assume that the number of grooves 13 formed in the sleeve 650 over the entire circumference of the sleeve 650 is n, and that the linear velocity of the sleeve 650 and that of the drum 40, as measured in the developing zone Nd, are Vs and Vp, respectively. Then, assuming that the maximum pitch that renders the stripe-like pitch irregularity in an image, corresponding to the grooves 13, unrecognizable by eye is P, there holds a relation of $n\geqq(L\cdot Vp)/(P\cdot Vs)$.

More specifically, in the first example, the number of grooves 13 formed in the sleeve 650 is selected to satisfy the above relation. The pitch of the pitch irregularity to appear in a toner image corresponds to the pitch of the grooves 13, as stated earlier. More specifically, the pitch Px of the pitch irregularity is expressed as:

$$Px=L/n\times(Vp/Vs) \quad (3)$$

As the above equation (3) indicates, the pitch Px decreases with an increase in the number n of grooves 13 or increases with an increase in the number n. Assuming that the number n of grooves 13 is minimum, then the relation of $n\geqq(L\cdot Vp)/(P\cdot Vs)$ is rewritten as:

$$n=(L\cdot Vp)/(P\cdot Vs) \quad (4)$$

By substituting the equation (4) for the equation (3), there is obtained:

$$Px=P \quad (5)$$

As stated above, in the first example, even when the number n of the grooves 13 formed in the sleeve 650 is minimum, the pitch Px of the pitch irregularity to appear in a toner image is as small as P that cannot be recognized by eye, as the equation (5) indicates.

<Second Example>

A second example differs from the first example in that the maximum pitch P is selected to be 0.5 mm. In this case, the relation of $n\geqq(L\cdot Vp)/(P\cdot Vs)$ is rewritten as:

$$n\geqq(L\cdot Vp)/(0.5Vs)$$

Figure 27:
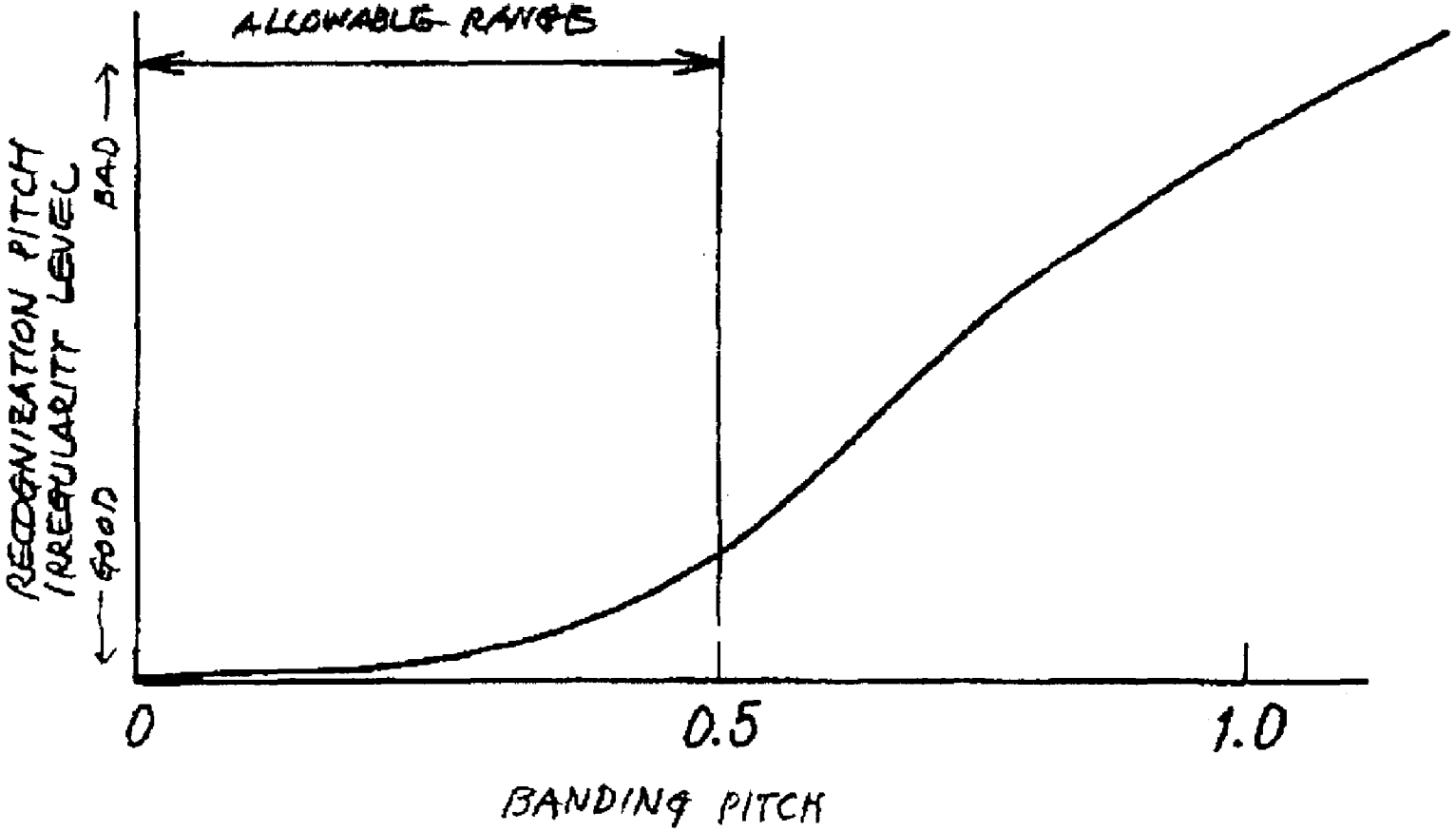
FIG. 27 is a graph showing a relation between a pitch on a photoconductive drum, corresponding to grooves, and the visible level of pitch irregularity or banding.

From this relation, the banding pitch to appear in a toner image is expressed as $LVp/nVs\leqq0.5$ FIG. 27 shows a relation between the pitch on the drum 40 corresponding to the pitch of the grooves 13 and the banding or pitch irregularity recognizable by eye. As shown, when use is made of the sleeve 650 whose grooves 13 satisfy the relation of $n\geqq LVp/0.5\ Vs$, the banding pitch can be confined in the range of 0.5 mm or below that is difficult to see by eye.

Figure 28:
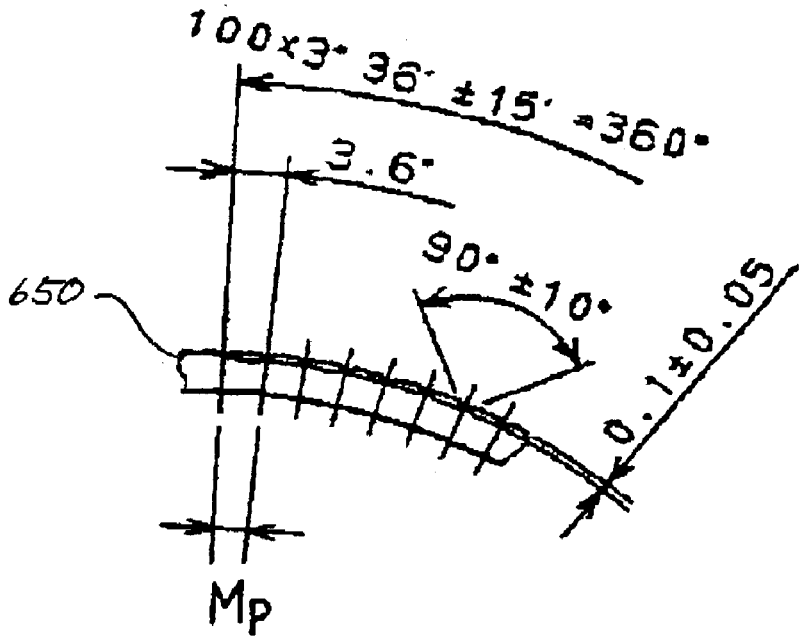
FIG. 28 is a section showing a specific configuration of the sleeve of the second embodiment.

FIG. 28 shows a more specific configuration of the sleeve 650 having an outside diameter d of 25 mm and formed with 100 grooves (n=100). The ratio of the linear velocity Vs of the sleeve 650 to the linear velocity Vp of the drum 40 is selected to be 2. By substituting the above conditions to the relation of $LVp/nVs\leqq0.5$, there is produced:

$$25\times n/100\times2\approx0.39\leqq0.5$$

Therefore, when the sleeve 650 with the above specific configuration is used, the banding can be reduced to a level that cannot be seen by eye.

<Thrird Example>

Figure 29:
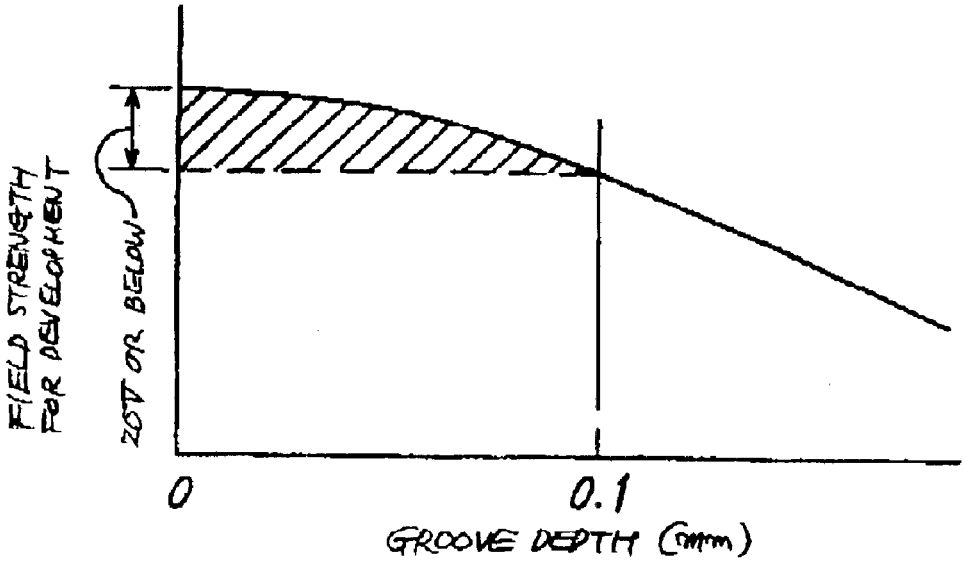
FIG. 29 is a graph showing a relation between the depth of the grooves and the strength of an electric field formed in the developing zone.

A third example differs from the first and second examples in that the grooves 13 formed in the sleeve 650 each are selected to fall between 0.01 mm and 0.1 mm. FIG. 29 shows a relation between the depth of the groove 13 and the strength of the electric field formed in the developing zone Nd. As shown, when the depth of the groove 13 exceeds 0.1 mm, the strength of the above electric field, corresponding to the groove 13, sharply decreases. As a result, a difference in strength between this electric field and the electric field, corresponding to the surface of the sleeve 650, increases and is apt to bring about the pitch irregularity. By contrast, when the depth of the groove 13 is 0.1 mm or below, the difference mentioned above and therefore the pitch irregularity decreases. Experiments conducted with the sleeve 650 of FIG. 28 showed that the difference mentioned above was 20 V or below, and that a difference of above 20 V rendered the pitch irregularity conspicuous. While the groove 13 should preferably be as shallow as possible, 0.01 mm is a limit available with the state-of-the-art technologies.

<Fourth Example>

Figure 30:
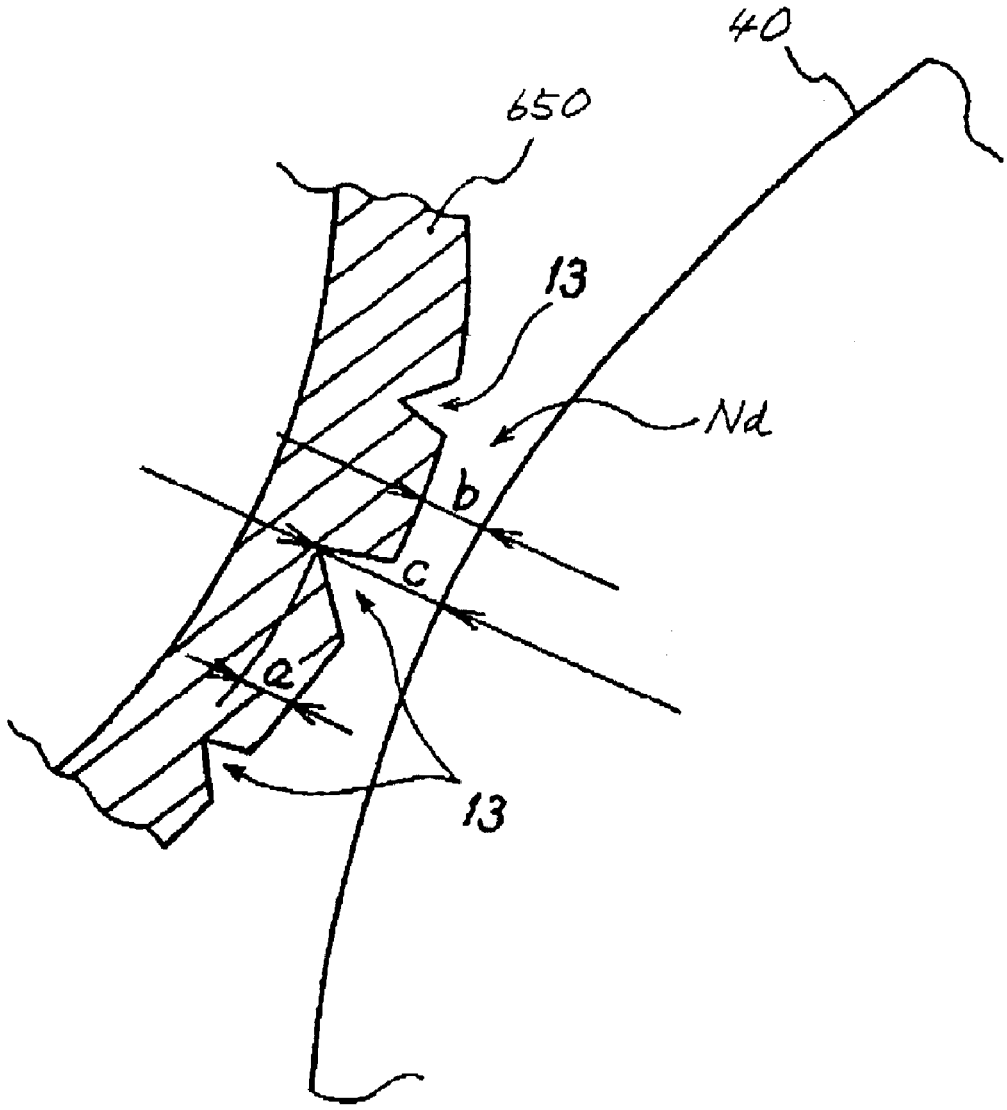
FIG. 30 is an enlarged fragmentary view showing the developing zone.

As shown in FIG. 30, a fourth example differs from the first to the third examples in that each groove 13 formed in the sleeve 650 is provided with a V-shaped cross-section As shown in FIG. 30, assume that each groove 13 has depth of a, that the electric field between the surface of the sleeve 650 and that to the drum 40, as measured in the developing zone Nd, has strength of b, and that the electric field between the groove 13 and the surface of the drum 40 in the developing zone Nd has strength of c. Then, a relation of b>c holds: the greater the difference (b−c), the more conspicuous the pitch irregularity.

In light of the above, how the field strengths b and c vary in accordance with the depth of the V-shaped groove 13, FIG. 28, was determined. In FIG. 16 showing the result of measurement, a solid line and a dotted line pertain to the depth a of 0.1 mm and the depth a of 0.15 mm, respectively. As FIG. 16 indicates, even when the V-shaped groove 13 is deeper than 0.1 mm, the difference (b−c) does not exceed 10 V and maintained the pitch irregularity inconspicuous.

Further, as shown in FIG. 18, the sleeve 650 with the V-shaped grooves 13 was more stable than a sandblasted sleeve as to the amount of scoop-up. Further, FIG. 31 compares the sleeve 650 of the illustrative embodiment and the conventional sleeve with V-shaped grooves, sleeve with square grooves and sandblasted sleeve as to developing conveying ability, banding and carrier deposition. In FIG. 31, circles and crosses are representative of "good" and "bad", respectively. As shown, the sleeve 650 of this example enhances developing conveying ability and reduces banding and carrier deposition.

<Fifth Example>

This example differs from the first to fourth examples in that it includes a configuration satisfying the condition (2) stated earlier, In a developing device of the type using a two-ingredient type developer, the grain size of the carrier should preferably be reduced to noticeably enhance image quality, as known in the art. For example, while a carrier grain size of 50 μm or above cannot improve granularity above 0.3 or so as for a halftone dot image having a color value of 60 to 90, a carrier grain size of about 35 μm improves granularity to 0.1, i.e., by almost three times, as shown in FIG. 13. This successfully improves dot reproducibility. Considering this fact, this example forms a toner image with a developer containing magnetic carrier grains whose grain size is 50 μm or below. While the carrier grain size should preferably be as small as possible, the minimum grain size available with the state-of-the-art technologies is 20 μm, as generally understood.

<Sixth Example>

A sixth example differs from the fifth example in that it additionally includes a configuration satisfying the condition (3) stated earlier. In a developing device of the type described, to enhance image quality, it is necessary to stabilize the amount ρ by which the developer is scooped up, or conveyed via the doctor 73, and to reduce the deterioration of the developer. The amount ρ and deterioration are noticeably influenced by the magnetic force distribution of the pole of the magnet roller 72 facing the doctor 73, the surface configuration of the sleeve 650, and the surface configuration of the developer. More specifically, as shown in FIG. 14, the amount ρ decreases due to the wear of the sleeve 650 and developer ascribable to aging, rendering an image non-smooth.

Further, even if granularity is improved by using the carrier grains with a small grain size, a decrease in the amount of scoop-up ascribable to the wear of the coating layers renders images non-smooth. The fall of the developer conveying ability ascribable to such wear becomes more conspicuous as the rotation speed of the sleeve 650 becomes higher because wear is more aggravated. A solution to this problem is a key to a future high speed, high image quality machine. One of major factors of the wear of coating layers is that carrier grains have heretofore been developed under the notion of extending the life by shaving off hard coating layers little by little.

Figure 32:
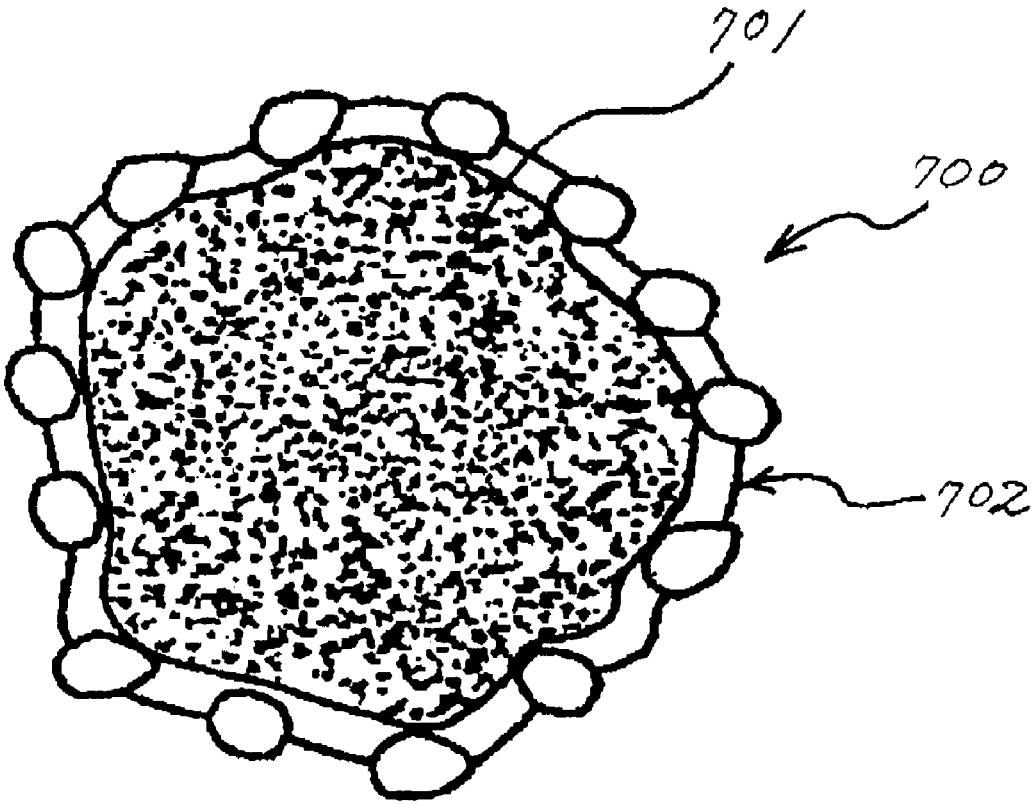
FIG. 32 shows a single carrier in an enlarged view.

To solve the above problem, as shown in FIG. 32, this example uses carrier grains 700 each consisting of a magnetic core 701 and a resin coating layer 702 covering the core 701. The resin coating layer 702 should preferably be elastic and highly adhesive. The elastic coating layer 702 absorbs impacts and is therefore shaved off little. Further, the highly adhesive coating layer 702 can retain the core 701 having a large size. In addition, the coating layer 702 contains grains smaller in grain size than the carrier 700 in its surface so as to protect the developer from impacts and improving the removal of spent substances. This successfully extends the life of the developer.

<Seventh Example>

A seventh example differs from the sixth example in that it additionally includes the following configuration. In the seventh example, the carrier grains 700 each consist of the core 701 formed of ferrite and the coating layer 702 in which a charge control agent is contained in a resin component produced by the crosslinking of acrylic resin or similar thermoplastic resin and melamine resin. With this configuration, the carrier grain 700 is shaved off little.

To form the grooves 13 in the sleeve 650 in any one of the specific examples described above, a hollow cylindrical tube formed of, e.g., aluminum may be subjected to drawing. The pitch of the grooves 13 is less than the maximum pitch P stated earlier. The grooves 13 may extend in the axial direction of the sleeve 650 or extend spirally along the surface of the sleeve 650. Further, the sleeve 650 formed with the grooves 13 may have its surface sandblasted in order to improve the developer conveying ability and obviate the pitch irregularity at the same time.

Image forming apparatuses other than the apparatus shown in FIGS. 2 and 4 and each using any one of the specific examples of the illustrative embodiment will be described hereinafter.

Figure 33:
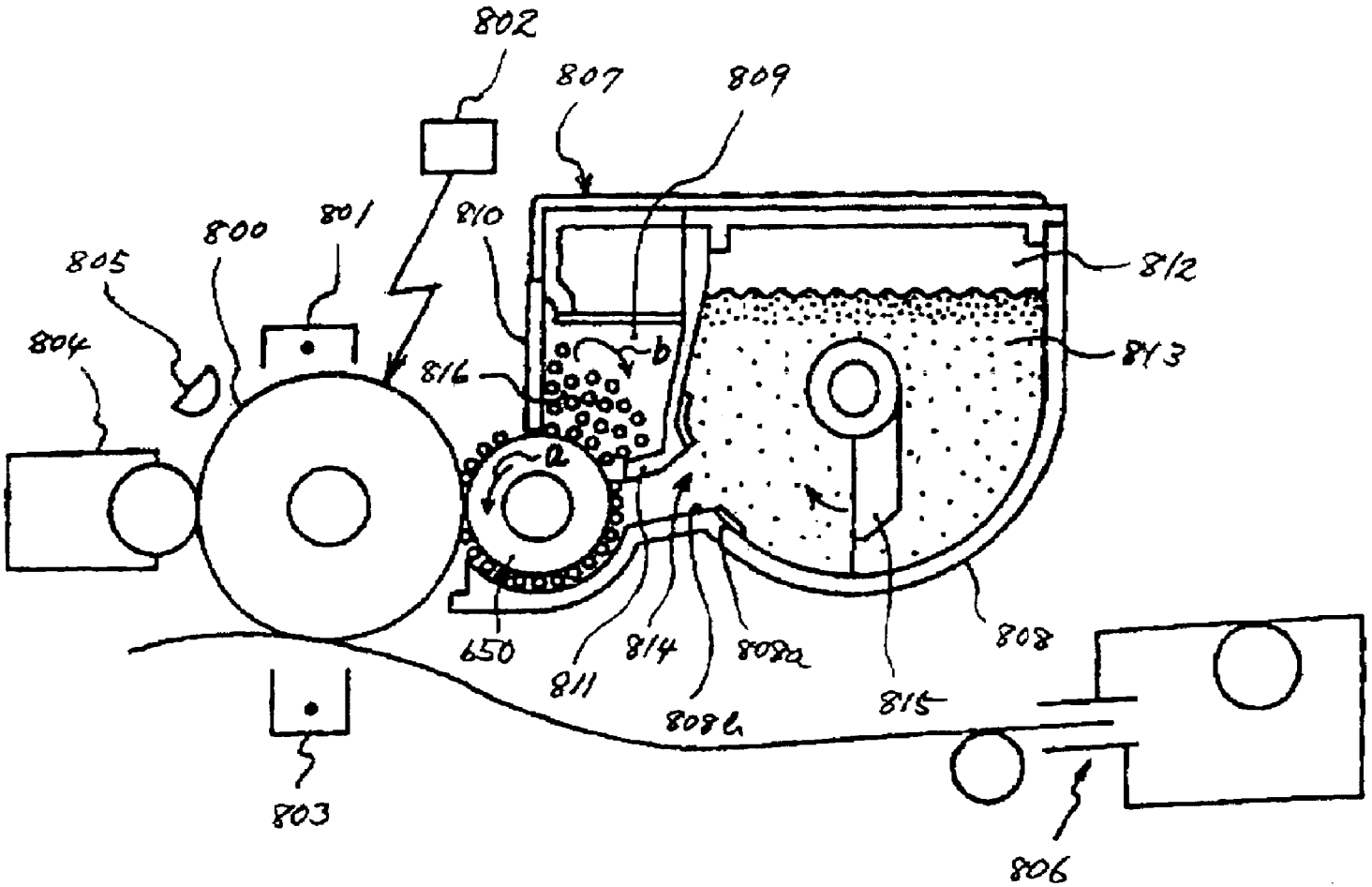
FIG. 33 shows part of an image forming apparatus including a developing device configured to automatically control the toner content of a developer.

FIG. 33 shows an image forming apparatus including a developing device configured to automatically control the toner content of the developer. As shown, the image forming apparatus includes a photoconductive drum 800 and a charger 801 adjoining the drum 800. An optical writing unit 802 scans the surface of the drum 800 uniformly charged by the charger 801 with, e.g., a laser beam to thereby form a latent image. A developing device 807 develops the latent image with toner to thereby form a corresponding toner image. An image transferring device 803 transfers a toner image formed on the drum 800 to a sheet. A drum cleaner 804 removes toner left on the drum 800 after the image transfer. A quenching lamp or discharger 805 removes potential left on the drum 800. Further included in the image forming apparatus are a sheet conveying device 806 and a fixing unit not shown.

The developing device 807 includes a case 808, the sleeve or developer carrier 650, a developer chamber or developer storing portion 809, a first and a second doctor 810 and 811, and a toner hopper 812. The case 808 is formed with an opening facing the drum 800 and so configured as to surround the lower portion of the sleeve 650. The sleeve 650 is rotatable around magnetic field generating means held stationary thereinside and implemented as a permanent magnet not shown. The first doctor 810 is spaced from the speed 650 by a preselected gap for regulating the thickness of the developer deposited on the sleeve 650.

The developer chamber 809 is positioned upstream of the first doctor 810 in the direction of rotation of the sleeve 650 and stores part of the developer removed by the doctor 810. The second doctor 811 is positioned at the bottom of the developer chamber 809 and spaced from the sleeve 650 by a preselected gap. When the toner content of the developer deposited on the sleeve 650 and therefore the thickness of the developer layer increases, the second doctor 811 removes the increment of the developer. The toner hopper 812, storing fresh toner 813 to be replenished, adjoins the developer chamber 809 and is constructed integrally with the case 808.

Part of the case 808 beneath the developer chamber 809 is implemented as a facing surface 808*a* formed with a projection 808*b*. The facing surface 808*a* extends over a preselected length while being inclined downward from the toner hopper 812 side toward the sleeve 650. The facing surface 802*a* and the bottom of the developer chamber 809 form a toner feed opening 814 for replenishing the fresh toner 813 from the hopper 812. An agitator or agitating member 815 is disposed in the toner hopper 812 for conveying the toner 813 toward the toner feed opening 814.

In FIG. 33, when a developer 816 is set in the developing device 807, the developer 816 is partly deposited on the sleeve 650 and partly introduced into the developer chamber 809. When the sleeve 650 rotates in a direction indicated by an arrow a, the developer in the developer chamber 809 is caused to circulate therein in a direction indicated by an arrow b due to the magnetic force of the sleeve 650, the weight of the developer 816 itself and so forth. As a result, an interface and a joining point are formed between the developer being conveyed by the sleeve 650 and the developer circulating in the developer chamber 809.

The developer chamber 809 is large enough to allow the developer 816 to circulate over the range in which the magnetic force of the sleeve 650 acts. In the developer chamber 809, the developer 816 present therein exerts a force that tends to obstruct the movement of the developer 816 being conveyed by the sleeve 650.

When the fresh toner 813 is replenished to the developer being conveyed by the sleeve 650 (moving developer layer) via the toner feed opening 814, the fresh toner 813 is conveyed to the interface mentioned above. As a result, the toner 813 lowers a frictional force acting between the moving developer layer and the circulating developer layer around the interface, thereby reducing the amount of the developer being conveyed around the interface.

On the other hand, the force, tending to obstruct the movement of the developer 816, does not act on part of the developer 816 positioned upstream of the joining point in the direction of rotation of the sleeve 650. Therefore, the developer 816 brought to the joining point and the developer 816 being conveyed at the interface are brought out of balance in amount. Consequently, the joining point shifts upward while the moving developer layer becomes thick until the developer accumulates at the position upstream of the second doctor 811.

When the developer accumulates at the above position until it stops the toner feed opening 814, the replenishment of the fresh toner 813 via the opening 814 ends. At this instant, the toner content and therefore the volume of the developer increases in the developer chamber 809, so that the space available in the chamber 809 decreases and stops the movement of the circulating developer layer. In this manner, the toner content of the developer deposited on the sleeve 650 is controlled to any preselected value.

Further, the developer 816 on the sleeve 650 is regulated by the first doctor 810 to adequate thickness and then conveyed to a developing zone where the sleeve 650 faces the drum 800. At the developing zone, only the toner of the developer 816 is electrostatically deposited on a latent image formed on the drum 800, thereby producing a corresponding toner image.

Figure 34:
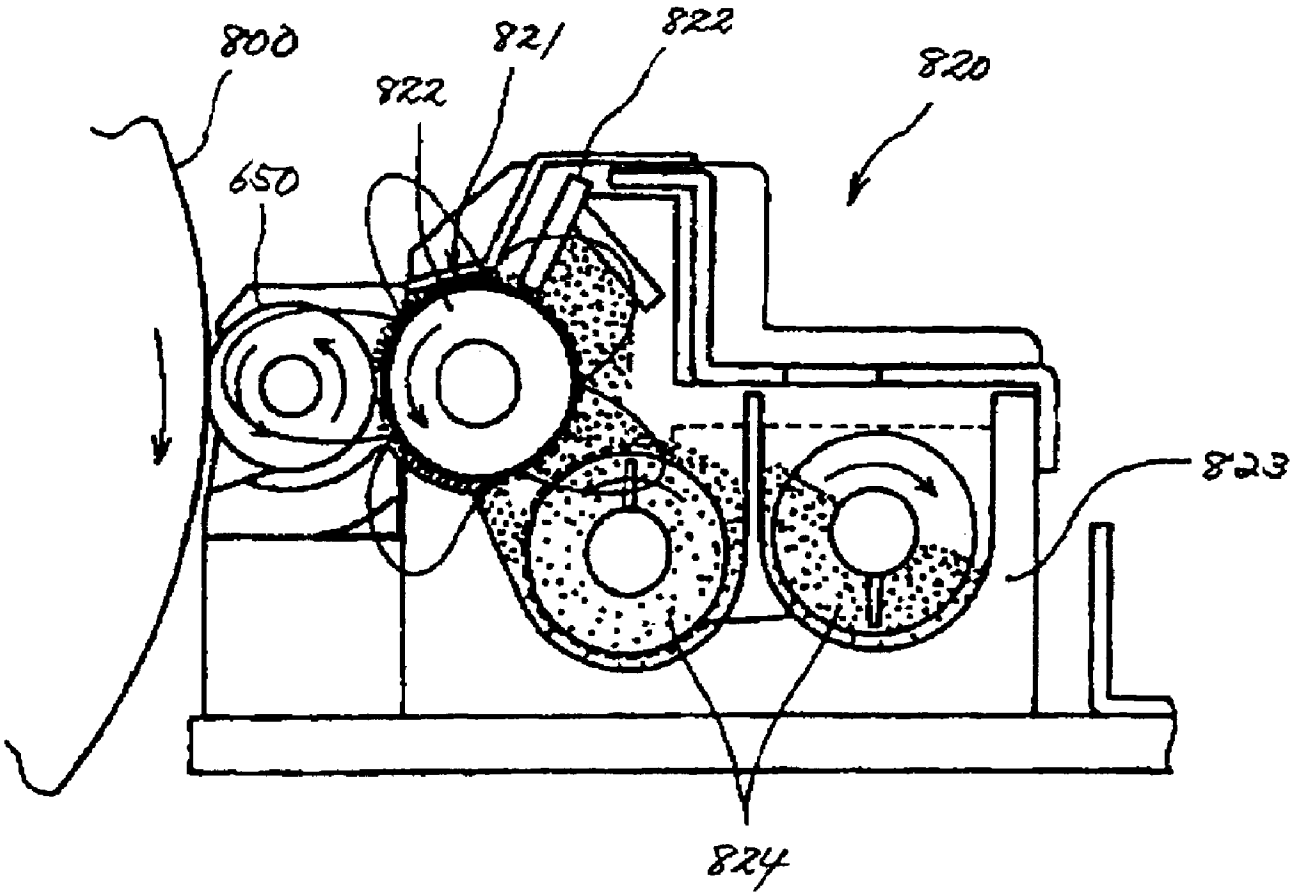
FIG. 34 shows a developing device configured to deposit only toner contained in a two-ingredient type developer on a sleeve.

FIG. 34 shows a developing device 820 configured to deposit only the toner of the two-ingredient type developer on the sleeve 650. As shown, the developing device 820 also includes the sleeve 650 contacting the drum 800. A toner feed roller 821 faces the sleeve 650 and accommodates a stationary magnet 822 thereinside. The two-ingredient type developer deposits on the toner feed roller 821 in the form of a magnet brush. When an electric field for feeding toner is selectively formed, only the toner of the magnet brush is fed from the toner feed roller 821 to the sleeve 650. Consequently, the toner forms an adequate, thin toner layer (preferably one to two layers) on the sleeve 650.

The toner feed roller 821 is implemented as a nonmagnetic, hollow cylinder formed of, e.g., aluminum, brass, stainless steel or conductive resin and caused to rotate by a drive mechanism not shown. A doctor 822 is positioned at the upstream portion of the toner feed roller 821 for metering the developer deposited on the roller 821. Further, a screw, paddle or similar agitator 824 is disposed in a casing 823 that stores the developer.

Figure 35:
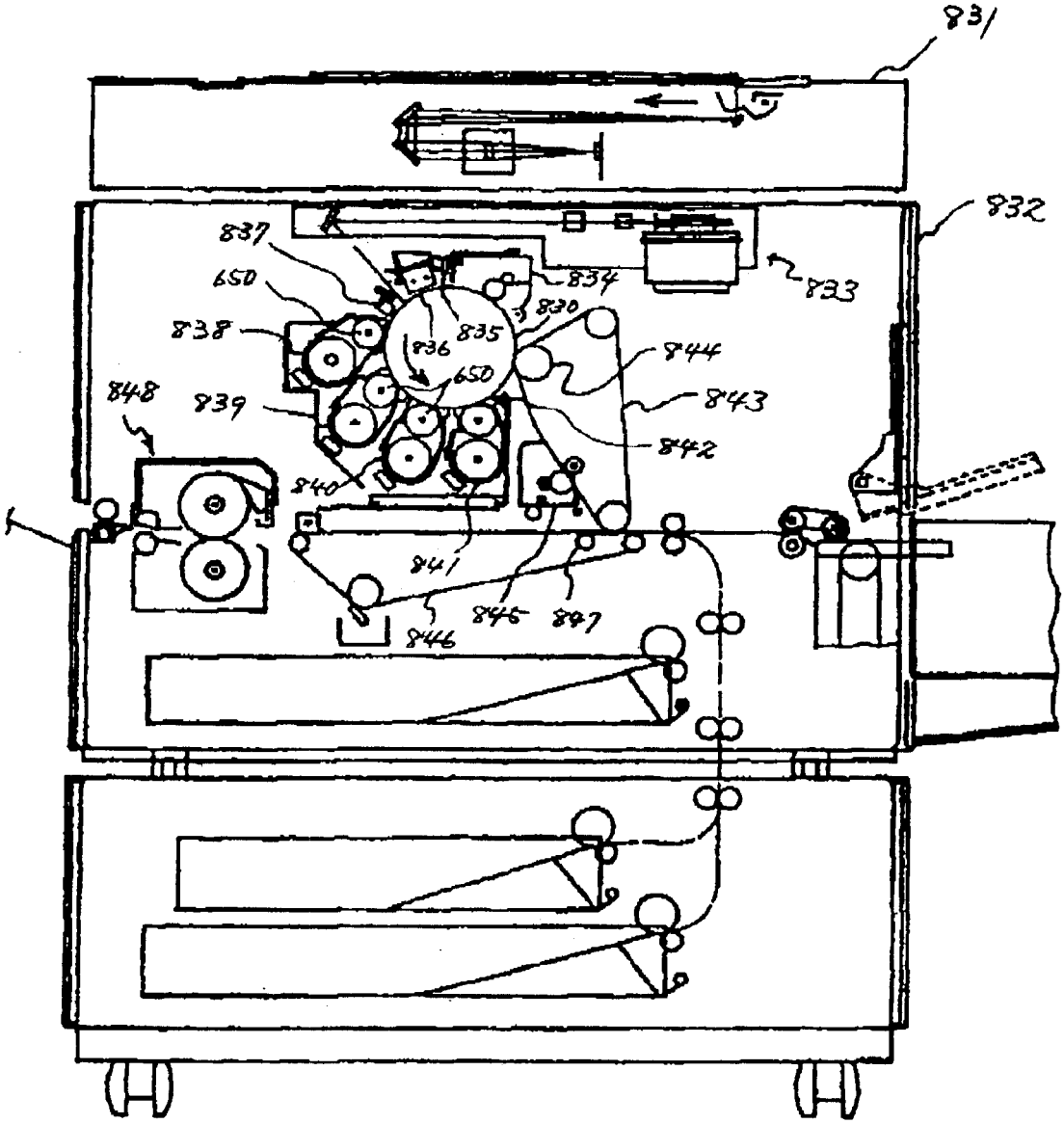
FIG. 35 shows an image forming apparatus capable of forming a color toner image on a photoconductive drum with a plurality of developing devices arranged around the drum.

FIG. 35 shows an image forming apparatus capable of forming a color toner image with a plurality of developing devices arranged around a photoconductive drum 830. As shown, a color scanner 831 reads color image information from a document with respect to each of separated colors, e.g., blue (B), green (G) and red (R) while converting them to electric image signals. An image processor, not shown, transforms the B, G and R image signals to black (Bk), cyan (C), magenta (M) and yellow (Y) color image data on the basis of the signal level.

A color printer 832 includes an optical writing unit 833 that converts the color image data to optical signals and scans the drum 830 with each of the optical signals for thereby forming a latent image. A drum cleaner 834, including a precleaning discharger, adjoins the drum 830. Also arranged around the drum 830 are a quenching lamp 835, a charger 836, a potential sensor 837, a Bk developing device 838, a C developing device 839, an M developing device 840, a Y developing device 841, and an optical sensor 842 responsive to the density of a density pattern. An intermediate image transfer belt unit includes an intermediate image transfer belt (simply belt hereinafter) 843 and an intermediate image transfer roller (simply roller hereinafter) 844. The Bk through Y developing devices 838 through 841 each include a sleeve 650, a paddle for scooping up the developer while agitating it, and a toner content sensor.

The belt 843 is passed over a drive roller, a driven roller and a primary image transfer roller (simply roller hereinafter) 844 and driven by a motor, not shown, via the drive roller. A moving mechanism, not shown, selectively moves the belt 843 into or out of contact with the drum 830. A belt cleaner 845 adjoins the belt 843 at a preselected position. The belt cleaner 845 is released from the belt 843 from the time when printing starts to the time when belt transfer of the trailing edge of a Y toner image ends, and again brought into contact with the belt 843 at preselected timing for cleaning it.

The image transfer belt unit faces part of the belt 843 passed over the drive roller. The belt 846 is passed over the roller 847, a drive roller, a driven roller and so forth so as to directly convey a sheet from the position where the belt 846 faces the drive roller assigned to the belt 843 to a fixing unit 848.

Figure 36:
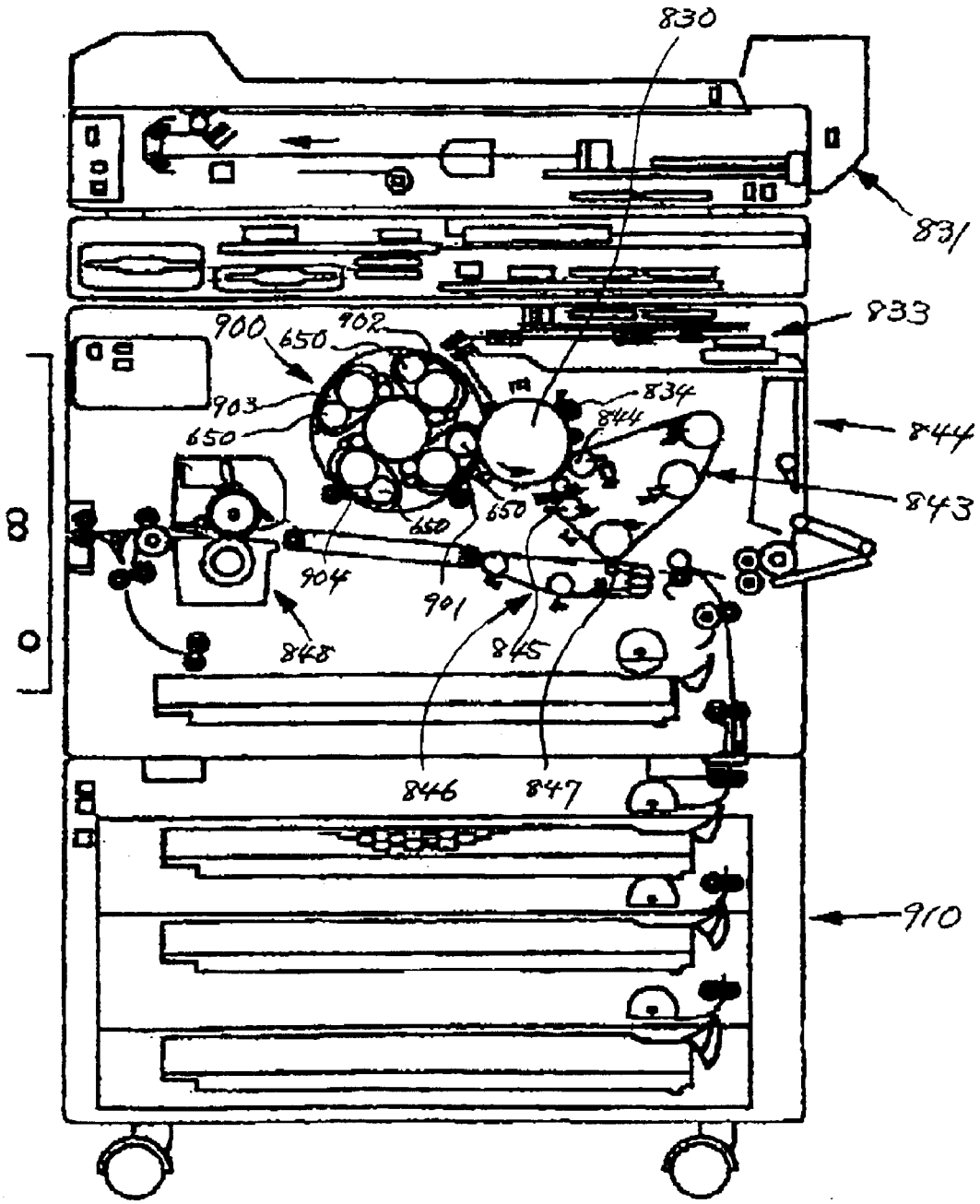
FIG. 36 shows an image forming apparatus using a revolver type developing device.

FIG. 36 shows an image forming apparatus in which the developing device is implemented as a revolver type developing unit 900. As shown, the revolver type developing unit (simply revolver hereinafter) 900 includes a Bk, a Y, a C and an M developing section 901, 902, 903 and 904. A revolver driver, not shown, causes the revolver 900 to bodily rotate counterclockwise, as viewed in FIG. 36. The Bk through M developing sections 901 through 904 each include the sleeve 650, a paddle for agitating the developer while scooping it up, and a driver for driving the sleeve 650. In FIG. 36, structural elements identical with those shown in FIG. 35 are designated by identical reference numerals and will not be described in order to avoid redundancy.

When the apparatus is in a stand-by state, the revolver 900 remains in a halt at its home position where the Bk developing section 901 faces the drum 830 at a developing position. When a copy start key is pressed, a latent image is formed on the drum 830 in accordance with Bk image data by the procedure stated earlier. Let the latent image derived from the Bk image data be referred to as a Bk latent image. This is also true with Y, C and M.

To develop the Bk latent image from its leading edge, the sleeve 650 of the Bk developing section 901 starts being rotated before the above leading edge arrives at the developing position, thereby developing the Bk latent image with Bk toner. Subsequently the revolver 900 is rotated as soon as the trailing edge of the Bk latent image moves away from the developing position, locating the next developing section at the developing position. This rotation of the revolver 900 completes at least before the leading edge of a latent image derived from the next image data arrives at the developing position.

On the start of the image formation, the drum 830 and belt 843 start being rotated counterclockwise, as viewed in FIG. 36, in synchronism with each other. Consequently, Bk, Y, C and M toner images sequentially formed on the drum 830 are sequentially transferred to the same area of the belt 843 one above the other, completing a composite color image (primary image transfer). At the time when the image forming operation begins, a sheet fed from a sheet bank 910 or a manual sheet teed tray is held in a stop by a registration roller pair. When the leading edge of the color image on the belt 843 reaches preselected position, the image transfer belt unit is brought into contact with the belt 843.

Subsequently, the registration roller pair conveys the sheet such that the leading edge of the sheet meets the leading edge of the color image carried on the belt 843. When the sheet met the color image is being conveyed via a secondary image transfer position, the roller 847 transfers the color image from the belt 843 to the sheet. The sheet is then separated from the belt 846 and conveyed to the fixing unit 848. The fixing unit 848 fixes the color image on the sheet with heat and pressure. Thereafter, the sheet or print is driven out of the apparatus body by an outlet roller pair not shown.

On the other hand, the toner left on the drum 830 after the primary image transfer is removed by the drum cleaner 834

Also, the toner left on the belt 843 after the secondary image transfer is removed by the belt cleaner 845.

In a repeat copy mode, after the first M or fourth-color toner image has been formed, the color scanner 831 and drum 830 advance to a step of forming the second Bk or first-color toner image at preselected timing. As for the belt 843, after the secondary image transfer of the first color image to a sheet, the second Bk toner image is transferred to the area cleaned by the belt cleaner 845. This is followed by the same procedure as with the first sheet.

In a three-color or a two-color mode, as distinguished from the four-color mode, the operation described above is repeated a number of times corresponding to desired colors and the number of desired copies. In a single-color mode, only the developing section of the revolver 900 corresponding to desired color is held operative at the developing position until a desired number of copies have been output. In this mode operation, the belt cleaner 845 is continuously pressed against the belt 843.

Various modifications will become possible for those skilled in the art after receiving the teachings of the present disclosure without departing from the scope thereof.

What is claimed is:

1. A developing device comprising:

a developer carrier whose surface is movable to convey a developer deposited thereon to a developing zone where said developer carrier faces an image carrier;

means, accommodated in said developer carrier, for generating a magnetic field that retains the developer on the surface of said developer carrier; and a metering member facing the surface of said developer carrier and configured to regulate an amount of the developer being conveyed by said surface toward the developing zone;

wherein the surface of said developer carrier is configured such that a center portion, including an image forming range corresponding to an image forming range of said image carrier, in a direction of width perpendicular to a direction of movement of said surface, includes a plurality of grooves at spaced locations along a circumference of said surface, each groove extending over the image forming range but terminating before reaching opposite end portions outward of said center portion, and opposite ends of a magnetic pole of said magnetic field generating means in the direction of width face the opposite end portions of said developer carrier.

2. The device as claimed in claim 1, wherein the opposite end portions of said developer carrier each have a smaller outside diameter than the center portion.

3. The device as claimed in claim 1, wherein a magnetic member adjoins said metering member at an upstream side in the direction of movement of the surface of said developer carrier and faces the opposite end portions of said developer carrier.

4. The device as claimed in claim 3, wherein the developer comprises a two-ingredient time developer made up of toner grains and magnetic carrier grains, said magnetic carrier grains each comprise a magnetic core and a resin coating layer formed on said magnetic core, and said resin coating layer comprises a resin component produced by crosslinking of acrylic resin or similar thermoplastic resin and melamine resin and containing a charge control agent.

5. The device as claimed in claim 1, further comprising a casing member configured to cover the opposite end portions of said developer carrier over a range between a position downstream of the developing zone in the direction of movement of the surface of said developer carrier and a position where said metering member is located.

6. The device as claimed in claim 5, wherein the opposite ends of the magnetic pole of said means for generating a magnetic field face portions of said developer carrier enclosed by said casing member.

7. The device as claimed in claim 1, wherein the opposite end portions of said developer carrier each have surface roughness of 5 $\mu$m or below, or 1 $\mu$m or above, in terms of ten-point means roughness Rz.

8. The device as claimed in claim 7, further comprising a casing member configured to cover the opposite end portions of said developer carrier over a range between a position downstream of the developing zone in the direction of movement of the surface of said developer carrier and a position where said metering member is located.

9. The device as claimed in claim 8, wherein the opposite ends of the magnetic pole of said means for generating a magnetic field face portions of said developer carrier enclosed by said casing member.

10. The device as claimed in claim 1, wherein a magnetic member adjoins said metering member at an upstream side in the direction of movement of the surface of said developer carrier and faces the opposite end portions of said developer carrier.

11. The device as claimed in claim 10, wherein the developer comprises a two-ingredient time developer made up of toner grains and magnetic carrier grains, said magnetic carrier grains each comprise a magnetic core and a resin coating layer formed on said magnetic core, and said resin coating layer comprises a resin component produced by crosslinking of acrylic resin or similar thermoplastic resin and melamine resin and containing a charge control agent.

12. The device as claimed in claim 10, further comprising a casing member configured to cover the opposite end portions of said developer carrier over a range between a position downstream of the developing zone in the direction of movement of the surface of said developer carrier and a position where said metering member is located.

13. The device as claimed in claim 12, wherein the opposite ends of the magnetic pole of said means for generating a magnetic field face portions of said developer carrier enclosed by said casing member.

14. The device as claimed in claim 1, further comprising a casing member configured to cover the opposite end portions of said developer carrier over a range between a position downstream of the developing zone in the direction of movement of the surface of said developer carrier and a position where said metering member is located.

15. The device as claimed in claim 14, wherein the opposite ends of the magnetic pole of said means for generating a magnetic field face portions of said developer carrier enclosed by said casing member.

16. An image forming apparatus comprising:

an image carrier;

latent image forming means for forming a latent image on said image carrier;

a developing device configured to develop the latent image to thereby produce a corresponding toner image; and image transferring means for transferring the toner image from said image carrier to a recording medium;

said developing device comprising:

a developer carrier whose surface is movable to convey a developer deposited thereon to a developing zone where said developer carrier faces said image carrier;

means, accommodated in said developer carrier, for generating a magnetic field that retains the developer on the surface of said developer carrier; and a metering member facing the surface of said developer carrier and configured to regulate an amount of the developer being conveyed by said surface toward the developing zone;

wherein the surface of said developer carrier is configured such that a center portion, including an image forming range corresponding to an image forming range of said image carrier, in a direction of width perpendicular to a direction of movement of said surface, includes a plurality of grooves at spaced locations along a circumference of said surface, each groove extending over the image forming range but terminating before reaching opposite end portions outward of said center portion, and opposite ends of a magnetic pole of said magnetic field generating means in the direction of width face the opposite end portions of said developer carrier.

17. The apparatus as claimed in claim 16, wherein a gap between said image carrier and said developer carrier in the developing region is between 0.25 mm and 0.4 mm.

18. A color image forming apparatus comprising:

a plurality of image carriers;

means for forming a particular latent image on each of said plurality of image carriers;

a plurality of developing devices each being assigned to a respective image carrier and configured to develop the latent image with toner of a particular color for thereby producing a corresponding toner image; and means for transferring toner images formed on said plurality of image carriers to a recording medium one above the other;

said plurality of developing devices each comprising:

a developer carrier whose surface is movable to convey a developer deposited thereon to a developing zone where said developer carrier faces said image carrier;

means, accommodated in said developer carrier, for forming a magnetic field that retains the developer on the surface of said developer carrier; and a metering member facing the surface of said developer carrier and configured to regulate an amount of the developer being conveyed by said surface toward the developing zone;

wherein the surface of said developer carrier is configured such that a center portion, including an image forming range corresponding to an image forming range of said image carrier, in a direction of width perpendicular to a direction of movement of said surface has a plurality of grooves at spaced locations along a circumference of said surface, each groove extending over the image forming range but terminating before reaching than opposite end portions outward of said center portion, and opposite ends of a magnetic pole of said magnetic field generating means in the direction of width face the opposite end portions of said developer carrier.

19. The apparatus as claimed in claim 18, wherein a gap between said image carrier and said developer carrier in the developing region is between 0.25 mm and 0.4 mm.

20. In a process cartridge removably mounted to a body of an image forming apparatus and comprising an image carrier and a developing device configured to develop a latent image formed on said image carrier, said developing device comprising:

a developer carrier whose surface is movable to convey a developer deposited thereon to a developing zone where said developer carrier faces said image carrier;

means, accommodated in said developer carrier, for generating a magnetic field that retains the developer on the surface of said developer carrier; and a metering member facing the surface of said developer carrier and configured to regulate an amount of the developer being conveyed by said surface toward the developing zone;

wherein the surface of said developer carrier is configured such that a center portion, including an image forming range corresponding to an image forming, range of said image carrier, in a direction of width perpendicular to a direction of movement of said surface has a plurality of grooves at spaced locations along a circumference of said surface, each groove extending over the image forming range but terminating before reaching opposite end portions of said developer carrier.

21. The cartridge as claimed in claim 20, wherein a gap between said image carrier and said developer carrier in the developing region is between 0.25 mm and 0.4 mm.

22. In a developing device comprising a developer carrier rotatable with a developer deposited on a surface thereof, which is formed with a plurality of grooves at spaced locations along a circumference, for conveying said developer to a developing region where said developer carrier faces an image carrier, thereby developing a latent image formed on said image carrier, assuming that a circumferential length of said surface of said developer carrier in a direction of rotation is L, a number of grooves formed in said developer carrier is n, a linear velocity of said surface of said developer carrier, as measured in said developing zone, is Vs, a linear velocity of a surface of said image carrier, as measured in said developing zone, is Vp, and that a maximum pitch of stripe-like pitch irregularity, which corresponds to said grooves, that renders said pitch irregularity unrecognizable by eye is P, then there holds a relation:

$$n \geqq (L \cdot Vp)/(P \cdot Vs).$$

23. The device as claimed in claim 22, wherein the maximum pitch P is 0.5 mm.

24. The device as claimed in claim 22, wherein a thickness of said grooves is between 0.01 mm and 0.1 mm.

25. The device as claimed in claim 24, wherein said grooves each have a V-shaped cross-section.

26. The device claimed in claim 25, wherein the developer comprises a two-ingredient type developer made up of toner grains and magnetic grains, and a grain size of said magnetic grains is between 20 $\mu$m and 50 $\mu$m.

27. The device as claimed in claim 26, wherein the magnetic grains each comprise a magnetic core and a resin coating layer formed on said magnetic core.

28. The device as claimed in claim 27, wherein the resin coating layer comprises a resin component produced by crosslinking of a thermoplastic resin and melamine resin and containing a charge control agent.

29. The device as claimed in claim 28, wherein the developer contains magnetic grains, and means for generating a magnetic field is accommodated in said developer carrier for generating a magnetic force on the surface of said developer carrier in a normal direction and a tangential direction.

30. The device as claimed in claim 28, wherein the developer comprises toner grains and magnetic grains, said device further comprises means, accommodated in said developer carrier, for generating a magnetic force on the surface of said developer carrier in a normal direction and a tangential direction, a first metering member configured to regulate an amount of the developer being conveyed by said developer carrier, a developer chamber configured to store the developer removed by said first metering member, a toner hopper adjoining said developer chamber for replenishing fresh toner to said developer carrier, and a second metering member positioned upstream of said first metering member in a direction of developer conveyance by said developer carrier and configured to remove, when a toner content of the developer on said developer carrier increases to increase a thickness of said developer, an increment of said developer being conveyed toward said developer chamber, and a condition in which the developer and the fresh toner contact each other is variable in accordance with a variation of the toner content of the developer on said developer carrier, whereby a condition in which said fresh toner is replenished to said developer is varied.

31. The device as claimed in claim 28, wherein the developer comprises a two-ingredient type developer made up of toner grains and magnetic grains, said developer carrier comprises a toner carrier facing a developer carrier on which the developer is deposited in a form of a magnet brush, and an electric field formed between said toner carrier and said developer carrier, facing each other, causes the toner grains of the magnet brush to be transferred to said toner carrier and then conveyed to the developing region by said toner carrier.

32. The device as claimed in claim 22, wherein a thickness of said grooves is between 0.01 mm and 0.1 mm.

33. The device as claimed in claim 32, wherein said grooves each have a V-shaped cross-section.

34. The device as claimed in claim 33, wherein the developer comprises a two-ingredient type developer made up of toner grains and magnetic grains, and a grain size of said magnetic grains is between 20 $\mu$m and 50 $\mu$m.

35. The device as claimed in claim 34, wherein the magnetic grains each comprise a magnetic core and a resin coating layer formed on said magnetic core.

36. The device as claimed in claim 35, wherein the resin coating layer comprises a resin component produced by crosslinking of a thermoplastic resin and melamine resin and containing a charge control agent.

37. The device as claimed in claim 36, wherein the developer contains magnetic grains, and means for generating a magnetic field is accommodated in said developer carrier for generating a magnetic force on the surface of said developer carrier in a normal direction and a tangential direction.

38. The device as claimed in claim 36, wherein the developer comprises toner grains and magnetic grains, said device further comprises means, accommodated in said developer carrier, for generating a magnetic force on the surface of said developer carrier in a normal direction and a tangential direction, a first metering member configured to regulate an amount of the developer being conveyed by said developer carrier, a developer chamber configured to store the developer removed by said first metering member, a toner hopper adjoining said developer chamber for replenishing fresh toner to said developer carrier, and a second metering member positioned upstream of said first metering member in a direction of developer conveyance by said developer carrier and configured to remove, when a toner content of the developer on said developer carrier increases to increase a thickness of said developer, an increment of said developer being conveyed toward said developer chamber, and a condition in which the developer and the fresh toner contact each other is variable in accordance with a variation of the toner content of the developer on said developer carrier, whereby a condition in which said fresh toner is replenished to said developer is varied.

39. The device as claimed in claim 36, wherein the developer comprises a two-ingredient type developer made up of toner grains and magnetic grains, said developer carrier comprises a toner carrier facing a developer carrier on which the developer is deposited in a form of a magnet brush, and an electric field formed between said toner carrier and said developer carrier, facing each other, causes the toner grains of the magnet brush to be transferred to said toner carrier and then conveyed to the developing region by said toner carrier.

40. The device as claimed in claim 22, wherein said grooves each have a V-shaped cross-section.

41. The device as claimed in claim 40, wherein the developer comprises a two-ingredient type developer made up of toner grains and magnetic grains, and a grain size of said magnetic grains is between 20 $\mu$m and 50 $\mu$m.

42. The device as claimed in claim 41, wherein the magnetic grains each comprise a magnetic core and a resin coating layer formed on said magnetic core.

43. The device as claimed in claim 42, wherein the resin coating layer comprises a resin component produced by cross linking of a thermoplastic resin and melamine resin and containing a charge control agent.

44. The device as claimed in claim 43, wherein the developer contains magnetic grains, and means for generating a magnetic field is accommodated in said developer carrier for generating a magnetic force on the surface of said developer carrier in a normal direction and a tangential direction.

45. The device as claimed in claim 43, wherein the developer comprises toner grains and magnetic grains, said device further comprises means, accommodated in said developer carrier, for generating a magnetic force on the surface of said developer carrier in a normal direction and a tangential direction, a first metering member configured to regulate an amount of the developer being conveyed by said developer carrier, a developer chamber configured to store the developer removed by said first metering member, a toner hopper adjoining said developer chamber for replenishing fresh toner to said developer carrier, and a second metering member positioned upstream of said first metering member in a direction of developer conveyance by said developer carrier and configured to remove, when a toner content of the developer on said developer carrier increases to increase a thickness of said developer, an increment of said developer being conveyed toward said developer chamber, and a condition in which the developer and the fresh toner contact each other is variable in accordance with a variation of the toner content of the developer on said developer carrier, whereby a condition in which said fresh toner is replenished to said developer is varied.

46. The device as claimed in claim 45, wherein the developer comprises a two-ingredient type developer made up of toner grains and magnetic grains, said developer carrier comprises a toner carrier facing a developer carrier on which the developer is deposited in a form of a magnet brush, and an electric field formed between said toner carrier and said developer carrier, facing each other, causes the toner grains of the magnet brush to be transferred to said toner carrier and then conveyed to the developing region by said toner carrier.

47. The device as claimed in claim 22, wherein the developer comprises a two-ingredient type developer made up of toner grains and magnetic grains, and a grain size of said magnetic grains is between 20 $\mu$m and 50 $\mu$m.

48. The device as claimed in claim 47, wherein the magnetic grains each comprise a magnetic core and a resin coating layer formed on said magnetic core.

49. The device as claimed in claim 48, wherein the resin coating layer comprises a resin component produced by crosslinking of a thermoplastic resin and melamine resin and containing a charge control agent.

50. The device as claimed in claim 49, wherein the developer contains magnetic grains, and means for generating a magnetic field is accommodated in said developer carrier for generating a magnetic force on the surface of said developer carrier in a normal direction and a tangential direction.

51. The device as claimed in claim 49, wherein the developer comprises toner grains and magnetic grains, said device further comprises means, accommodated in said developer carrier, for generating a magnetic force on the surface of said developer carrier in a normal direction and a tangential direction, a first metering member configured to regulate an amount of the developer being conveyed by said developer carrier, a developer chamber configured to store the developer removed by said first metering member, a toner hopper adjoining said developer chamber for replenishing fresh toner to said developer carrier, and a second metering member positioned upstream of said first metering member in a direction of developer conveyance by said developer carrier and configured to remove, when a toner content of the developer on said developer carrier increases to increase a thickness of said developer, an increment of said developer being conveyed toward said developer chamber, and a condition in which the developer and the fresh toner contact each other is variable in accordance with a variation of the toner content of the developer on said developer carrier, whereby a condition in which said fresh toner is replenished to said developer is varied.

52. The device as claimed in claim 49, wherein the developer comprises a two-ingredient type developer made up of toner grains and magnetic grains, said developer carrier comprises a toner carrier facing a developer carrier on which the developer is deposited in a form of a magnet brush, and an electric field formed between said toner carrier and said developer carrier, facing each other, causes the toner grains of the magnet brush to be transferred to said toner carrier and then conveyed to the developing region by said toner carrier.

53. The device as claimed in claim 22, wherein the developer contains magnetic grains, and means for generating a magnetic field is accommodated in said developer carrier for generating a magnetic force on the surface of said developer carrier in a normal direction and a tangential direction.

54. The device as claimed in claim 22, wherein the developer comprises toner grains and magnetic grains, said device further comprises means, accommodated in said developer carrier, for generating a magnetic force on the surface of said developer carrier in a normal direction and a tangential direction, a first metering member configured to regulate an amount of the developer being conveyed by said developer carrier, a developer chamber configured to store the developer removed by said first metering member, a toner hopper adjoining said developer chamber for replenishing fresh toner to said developer carrier, and a second metering member positioned upstream of said first metering member in a direction of developer conveyance by said developer carrier and configured to remove, when a toner content of the developer on said developer carrier increases to increase a thickness of said developer, an increment of said developer being conveyed toward said developer chamber, and a condition in which the developer and the fresh toner contact each other is variable in accordance with a variation of the toner content of the developer on said developer carrier, whereby a condition in which said fresh toner is replenished to said developer is varied.

55. The device as claimed in claim 22, wherein the developer comprises a two-ingredient type developer made up of toner grains and magnetic grains, said developer carrier comprises a toner carrier facing a developer carrier on which the developer is deposited in a form of a magnet brush, and an electric field formed between said toner carrier and said developer carrier, facing each other, causes the toner grains of the magnet brush to be transferred to said toner carrier and then conveyed to the developing region by said toner carrier.

56. In a developer carrier for a developing device, said developer carrier is rotatable with a developer deposited on a surface thereof, which is formed with a plurality of grooves at spaced locations along a circumference, for conveying said developer to a developing region where said developer carrier faces an image carrier, thereby developing a latent image formed on said image carrier, assuming that a circumferential length of said surface of said developer carrier in a direction of rotation is L, a number of grooves formed in said developer carrier is n, a linear velocity of said surface of said developer carrier, as measured in said developing zone, is Vs, a linear velocity of a surface of said image carrier, as measured in said developing zone, is Vp, and that a maximum pitch of stripe-like pitch irregularity, which corresponds to said grooves, that renders said pitch irregularity unrecognizable by eye is P, then there holds a relation:

$$n \geqq (L \cdot Vp)/(P \cdot Vs), \text{ and}$$

said grooves are formed by drawing a hollow cylindrical tube.

57. The developer carrier as claimed in claim 56, wherein said grooves have a pitch smaller than the maximum pitch P.

58. The developer carrier as claimed in claim 56, wherein said grooves are formed spirally along the surface of said developer carrier.

59. The developer carrier as claimed in claim 56, wherein the surface of said developer carrier is sandblasted.

60. In an image forming method for conveying, in a developing device comprising a developer carrier rotatable with a developer deposited thereon and formed with a plurality of grooves, said developer deposited on said developer carrier to a developing zone where a surface of said developer carrier and a surface of an image carrier, carrying a latent image thereon, face each other and move in a same direction, thereby developing said latent image to thereby form a corresponding toner image, assuming that a circumferential length of said surface of said developer carrier in a direction of rotation is L, a number of grooves formed in said developer carrier is n, a linear velocity of said surface of said developer carrier, as measured in said developing zone, is Vs, a linear velocity of a surface of said image carrier, as measured in said developing zone, is Vp, and that a maximum pitch P of stripe-like pitch irregularity, which corresponds to said grooves, that renders said pitch irregularity unrecognizable by eye is greater than or equal to 0.5, then image formation is executed under a condition:

$$Vp/Vs \geqq n(P/L).$$

61. An image forming apparatus comprising:

an image carrier rotatable while carrying a latent image formed on a surface thereof;

means for forming the latent image; and a developing device configured to convey a developer deposited thereon to a developing zone where said developer carrier faces said image carrier for thereby developing the latent image;

wherein the surface of said developer carrier is formed with a plurality of grooves at spaced locations along a circumference, and assuming that a circumferential length of said surface of said developer carrier in a direction of rotation is L, a number of grooves formed in said developer carrier is n, a linear velocity of said surface of said developer carrier, as measured in said developing zone, is Vs, a linear velocity of a surface of said image carrier, as measured in said developing zone, is Vp, and that a maximum pitch of stripe-like pitch irregularity, which corresponds to said grooves, that renders said pitch irregularity unrecognizable by eye is P, then there holds a relation:

$$n \geqq (L \cdot Vp)/(P \cdot Vs).$$

62. The apparatus as claimed in claim 61, wherein assuming that a nip, forming the developing zone between said image carrier and said developer carrier, has a width of N, and that said grooves have a pitch of Mp, then there holds a relation:

$$N \geqq Mp.$$

63. The apparatus as claimed in claim 61, wherein said developing device comprises a plurality of developer carriers arranged around said image carrier in a direction of rotation of the surface of said image carrier for sequentially forming toner images on said image carrier with developers of different colors one above the other.

64. The apparatus as claimed in claim 61, wherein said developing device comprises a plurality of developer carriers revolvable about an axis of rotation to sequentially face the surface of said image carrier in the developing zone and sequentially forms toner images on said image carrier one above the other with developers of different colors deposited on said plurality of developer carriers.

65. The apparatus as claimed in claim 61, wherein said image carrier, said means for forming the latent image and developing units of said developing device constitute a plurality of image forming units arranged side by side along a path on which a recording medium is conveyed, and toner images of different colors formed by said plurality of image forming units are sequentially transferred to said recording medium one above the other.

* * * * *